US008919396B2

(12) United States Patent
Nieves

(10) Patent No.: US 8,919,396 B2
(45) Date of Patent: Dec. 30, 2014

(54) MULTIPLE POCKETBOOKS IN ONE WITH PRIMARY POCKETBOOK AND ACCESSORY ATTACHING AND DETACHING SYSTEM AND METHOD

(76) Inventor: Julian R. Nieves, Armonk, NY (US)

( * ) Notice: Subject to any disclaimer, the term of this patent is extended or adjusted under 35 U.S.C. 154(b) by 199 days.

(21) Appl. No.: 13/288,501

(22) Filed: Nov. 3, 2011

(65) Prior Publication Data

US 2012/0103481 A1 May 3, 2012

Related U.S. Application Data

(60) Provisional application No. 61/409,601, filed on Nov. 3, 2010.

(51) Int. Cl.

| | |
|---|---|
| ***A45C 1/02*** | (2006.01) |
| ***A45C 7/00*** | (2006.01) |
| ***A45C 3/06*** | (2006.01) |
| ***A45C 13/10*** | (2006.01) |

(52) U.S. Cl.

CPC ..... *A45C 7/0086* (2013.01); *A45C 3/06* (2013.01); *A45C 7/009* (2013.01); *A45C 13/10* (2013.01)

USPC ..... 150/113; 150/101; 150/102; 150/103; 150/104; 150/105; 150/111; 150/112; 190/107; 190/108; 383/117; 383/22; 383/24; D3/233; D3/283; D3/289; 224/580; 224/582; 224/583

(58) Field of Classification Search

USPC ..... 150/100–113; 190/102, 103, 107, 108; 224/576, 577, 580, 582, 583, 632; 383/13, 117, 24, 38, 40; D3/214, 232, D3/233, 246, 283, 289, 318

See application file for complete search history.

(56) References Cited

U.S. PATENT DOCUMENTS

| | | | | |
|---|---|---|---|---|
| 4,112,991 | A * | 9/1978 | Barbaresi | 150/104 |
| 4,257,463 | A * | 3/1981 | Monaco | 150/111 |
| 5,044,699 | A | 9/1991 | Duty | |
| 6,237,660 | B1 | 5/2001 | Giardino | |
| D479,909 | S * | 9/2003 | Staples | D3/233 |
| 7,108,900 | B1 | 9/2006 | Manning Porter | |
| 7,942,296 | B1 | 5/2011 | Johnson | |
| 2009/0080808 | A1 | 3/2009 | Hagen | |
| 2010/0218863 | A1 * | 9/2010 | Church et al. | 150/105 |

* cited by examiner

*Primary Examiner* — Fenn Mathew
*Assistant Examiner* — Cynthia Collado
(74) *Attorney, Agent, or Firm* — Richard Mark Blank, Esq.

(57) ABSTRACT

The present invention relates to a pocketbook system that allows to easily mix and match how many pocketbooks, other carriers, and/or straps will suffice for that day or evenings' use while this pocketbook system is easy to use and inexpensive to manufacture. More particularly, the pocketbook system has a primary pocketbook for carrying contents, one or more removably attached secondary carrier for carrying contents, a device(s) for removably attaching the secondary carrier(s) to the inside or outside of the primary pocketbook, or for attaching the primary pocketbook and secondary carrier together, and preferably has at least one removable flexible strap(s) and a device(s) for removably attaching the strap(s) to the primary pocketbook and/or secondary carrier. The user makes use of the pocketbook system by attaching, detaching, re-attaching, exchanging, and switching different parts and/or elements to form a suitable pocketbook structure for a particular use at a particular time.

20 Claims, 16 Drawing Sheets

MULTIPLE POCKETBOOKS IN ONE WITH PRIMARY POCKETBOOK AND ACCESSORY ATTACHING AND DETACHING SYSTEM AND METHOD

This application claims the benefit under 35 U.S.C. 119(e) of U.S. provisional Application No. 61/409,601, having a filing date of Nov. 3, 2010, the entire disclosures of which are incorporated herein by reference.

FIELD OF INVENTION

The present invention relates to devices and methods for purses, pocketbooks, and handbags, and more particularly to a pocketbook system that gives the user the flexibility and choice to easily mix and match how many pocketbooks and/or other carriers and/or strap(s) will suffice for that day or evenings' use while this pocketbook system is still being easy to use and inexpensive to manufacture.

A pocketbook system comprising a primary pocketbook for carrying certain contents and one or more removably attached secondary carrier(s) for carrying certain contents that are typically or usually stored or found in a pocketbook, and a device(s) for removably attaching the secondary carrier(s) to the inside or outside of the primary pocketbook, or for attaching the primary pocketbook and secondary carrier(s) together. At least one of the primary pocketbook and/or removably attached secondary carrier(s) having an opening or a loop for receiving the device for removably attaching. The pocketbook system will preferably have at least one removable flexible strap(s) and a device(s) for removably attaching the removable flexible strap(s) to at least one of the primary pocketbook and/or removably attached secondary carrier(s). At least one of the primary pocketbook, removably attached secondary carrier(s), and/or removable flexible strap(s), having an opening in or a loop attached to it for receiving the device for removably attaching.

The user makes use of the pocketbook system by attaching, detaching, re-attaching, exchanging, and switching different parts and/or elements to form a suitable pocketbook structure for a particular use at a particular time.

There is a need for a pocketbook system that gives the user the flexibility, ability, and choice to easily mix and match how many pocketbooks and/or other carriers and/or strap(s) will be sufficient for the users' purposes for that day or evenings' use while this pocketbook system is still being easy to use and inexpensive to manufacture.

One of the objects of this device is to satisfy this need.

BACKGROUND OF INVENTION

A primary pocketbook can refer to a tote, pouch, bag, purse, handbags, pocketbook, clutch, etc. which is typically hand held or carried with a strap(s) and used to transport personal items, such as holding money, toiletries, small purchases, credit cards, checkbook, glasses etc. These pocketbooks are commonly used as an everyday necessity for individuals storing their needed items and always relying on having them in an easily located place. Many different styles of pocketbook have been created and designed.

A removably attached secondary carrier(s) can refer to a tote, pouch, pocketbook, purse, handbag, pocketbook, clutch, wallet, cellphone case, organizer, or eyewear case, etc., and can have one or more openings, e.g., slits or pockets, for carrying certain of the contents. The removably attached secondary carrier(s) may have one opening for a cell phone, or several openings to carry lipsticks, pens, compacts, money, creams, gum, perfumes, etc., or any combination of large and small openings for holding any type of accessory that one might wish to carry in the primary pocketbook. The opening or openings can be closable, e.g., a zippered opening for holding money.

Having a small removably attached secondary carrier(s) within the primary pocketbook allows for one to carry particular items in a designated removable place and also allows for one to remove the removably attached secondary carrier(s) easily and carry a smaller amount of contents without the larger primary pocketbook.

Having a large or small removably attached secondary carrier(s) outside of and removably attached to a primary pocketbook allows for one to carry particular items in a designated removable place and also allows for one to remove the removably attached secondary carrier(s) easily and carry all or a smaller amount of contents without use of the primary pocketbook.

There have been many attempts to make pocketbooks more accommodating. However, there is a need for a pocketbook system that gives the user the enormous flexibility, ability, and choice of this pocketbook system to easily mix and match how many pocketbooks and/or other carriers and/or strap(s) will be sufficient or desired for that day or evenings' use while this pocketbook system is still easy to use and inexpensive to manufacture.

One of the objects of this device is to satisfy this need.

SUMMARY OF THE INVENTION

The present invention relates to devices and methods for purses, pocketbooks, and handbags, and more particularly to a pocketbook system that gives the user the flexibility and choice to easily mix and match how many pocketbooks and/or other carriers and/or strap(s) will suffice for that day or evenings' use while this pocketbook system is still being easy to use and inexpensive to manufacture.

A pocketbook system comprising a primary pocketbook for carrying certain contents and one or more removably attached secondary carrier(s) for carrying certain contents that are typically or usually stored or found in a pocketbook, and a device(s) for removably attaching the secondary carrier(s) to the inside or outside of the primary pocketbook, or for attaching the primary pocketbook and secondary carrier(s) together. At least one of the primary pocketbook and/or removably attached secondary carrier(s) having an opening or a loop for receiving the device for removably attaching. The pocketbook system will preferably have at least one removable flexible strap(s) and a device(s) for removably attaching the removable flexible strap(s) to at least one of the primary pocketbook and/or removably attached secondary carrier(s). At least one of the primary pocketbook, removably attached secondary carrier(s), and/or removable flexible strap(s), having an opening in or a loop attached to it for receiving the device for removably attaching.

The user makes use of the pocketbook system by attaching, detaching, re-attaching, exchanging, and switching different parts and/or elements to form a suitable pocketbook structure for a particular use at a particular time.

A primary pocketbook can refer to a tote, pouch, pocketbook, purse, handbag, pocketbook, clutch, etc.; it is typically hand held or carried with a strap(s) and used to transport personal items, such as holding money, toiletries, small purchases, credit cards, checkbook, glasses etc. These pocketbooks are commonly used as an everyday necessity for individuals storing their needed items and always relying on having them in an easily located place. Many different styles of pocketbook have been created and designed.

A removably attached secondary carrier(s) can refer to a tote, pouch, pocketbook, purse, handbag, pocketbook, clutch, wallet, cellphone case, organizer, or eyewear case, etc., and can have one or more openings, e.g., slits or pockets, for carrying certain of the contents. The removably attached secondary carrier(s) may have one opening for a cell phone, or several openings to carry lipsticks, pens, compacts, money, creams, gum, perfumes, etc., or any combination of large and small openings for holding any type of accessory that one might wish to carry in the primary pocketbook. The opening or openings can be closable, e.g., a zippered opening for holding money.

Having a small pocketbook removably attached secondary carrier(s) within a primary pocketbook allows for one to carry particular items in a designated removable place and also allows for one to remove the removably attached secondary carrier(s) easily and carry a smaller amount of contents without the larger primary pocketbook.

Having a large or small removably attached secondary carrier(s) outside of and removably attached to a primary pocketbook allows for one to carry particular items in a designated removable place and also allows for one to remove the removably attached secondary carrier(s) easily and carry all or a smaller amount of contents without use of the primary pocketbook.

A primary pocketbook, such as a tote, pouch, purse, handbag, pocketbook, clutch, etc., having one or more removably attached secondary carrier(s), such as a tote, pouch, purse, handbag, pocketbook, clutch, etc., removably attached to such primary pocketbook. The primary pocketbook and the removably attached secondary carrier(s) having a device for attaching, detaching and re-attaching the removably attached secondary carrier(s) to the inside or outside of the primary pocketbook. The device being any type of mechanism for removably attaching the pocketbooks. Such devices including Velcro®, snaps, magnets, one or more loops or rings, an interlocking ring or rings, zippers, buttons, carabiner(s), hook(s), buckles, etc.

The removably attached secondary carrier(s) is the same type or a different type of pocketbook from the primary pocketbook. The removably attached secondary carrier(s) enhances the aesthetic and decorative aspects of the primary pocketbook when the removably attached secondary carrier(s) is removably attached to the outside of the primary pocketbook. The removably attached secondary carrier(s) can have a removable strap(s), which is the same or different from a removable strap(s) used for the primary pocketbook, so that it can be carried on the shoulder(s) or by the hand when it is detached from the primary pocketbook. The removably attached secondary carrier(s) can be used as a clutch in the absence of such strap(s).

The strap(s) can be removably attached by any type of mechanism for attaching, detaching, and re-attaching the strap(s). Examples of such a mechanism including Velcro®, snaps, magnets, one or more loops or rings, an interlocking ring or rings, zippers, buttons, carabiner(s), hook(s), buckles, etc. In one instance there is an opening in the pocketbook or a loop attached to the pocketbook for receiving such mechanism, e.g., a circular ring or non-circular shaped loop made of metal, plastic, wood, etc.

The primary pocketbook can also have a removable strap(s) so that it can be carried on the shoulder(s) or by the hand. This strap(s) can also be removably attached by any type of mechanism for attaching, detaching, and re-attaching the strap(s). Examples of such a mechanism including Velcro®, snaps, magnets, one or more loops or rings, an interlocking ring or rings, zippers, buttons, carabiner(s), hook(s), buckles, etc. In one instance there is an opening in the pocketbook or a loop attached to the pocketbook for receiving such mechanism, e.g., a circular ring or non-circular shaped loop made of metal, plastic, wood, etc. (referred to herein as an "attaching ring").

The primary and removably attached secondary carrier(s) can be removably attached at one or more points of attachment using a mechanism for attaching, detaching, and re-attaching the pocketbooks. Examples of such a mechanism including Velcro®, snaps, magnets, one or more loops or rings, an interlocking ring or rings, zippers, buttons, carabiner(s), hook(s), buckles, etc. The appearance of the primary and removably attached secondary carrier(s) can be enhanced by the use of an interlocking loop or loops at one or more points of attachment. The type of loops to use include, but are not limited to, circular rings that have a hinge in the circle so that part of the ring can be pushed inwardly to open. This type of ring can have angled ends at either end of the opening.

The primary and/or removably attached secondary carrier(s) can have one or more openings for receiving an attaching mechanism, e.g., a circular ring or non-circular shaped loop made of metal, plastic, wood, etc. (referred to herein as an "attaching ring"). Grommets can be used to reinforce the opening(s). One or more attaching rings can be used to attach the primary pocketbook to the removably attached secondary carrier(s). These attaching rings can also be used to attach one or more straps to either or both the primary pocketbook and the removably attached secondary carrier(s).

The invention is a multiple of pocketbooks in one. The primary pocketbook with a removably attached secondary carrier(s) attached is one version of a pocketbook. Also, the primary pocketbook with two removably attached secondary carrier(s) attached is another version of a pocketbook. Various multiple pocketbooks can be produced by adding additional removably attached secondary carrier(s) to the primary pocketbook. Additionally, the primary pocketbook, alone, is another pocketbook. Any one or more of the removably attached secondary carrier(s) alone is yet another version of a pocketbook. Two or more removably attached secondary carrier(s) attached together is another version of a pocketbook. One or more straps can be added to make additional versions of pocketbooks. In the absence of straps, the primary and/or removably attached secondary carrier(s) can be used as a clutch pocketbook, which is yet another version of a pocketbook. The possibilities are endless.

There is a need for a pocketbook system that gives the user the flexibility, ability, and choice to easily mix and match how many pocketbooks and/or other carriers and/or strap(s) will suffice for that day or evenings' use while this pocketbook system is still being easy to use and inexpensive to manufacture.

One of the objects of this device is to satisfy this need.

Still further uses and advantages will become apparent from a consideration of the ensuing description and drawings. The device is reusable.

BRIEF DESCRIPTION OF THE INVENTION

The present invention relates to devices and methods for purses, pocketbooks, and handbags, and more particularly to a pocketbook system that gives the user the flexibility and choice to easily mix and match how many pocketbooks and/or other carriers and/or strap(s) will suffice for that day or evenings' use while this pocketbook system is still being easy to use and inexpensive to manufacture.

A pocketbook system comprising a primary pocketbook for carrying certain contents and one or more removably attached secondary carrier(s) for carrying certain contents that are typically or usually stored or found in a pocketbook, and a device(s) for removably attaching the secondary carrier(s) to the inside or outside of the primary pocketbook, or for attaching the primary pocketbook and secondary carrier(s) together. At least one of the primary pocketbook and/or removably attached secondary carrier(s) having an opening or a loop for receiving the device for removably attaching. The pocketbook system will preferably have at least one removable flexible strap(s) and a device(s) for removably attaching the removable flexible strap(s) to at least one of the primary pocketbook and/or removably attached secondary carrier(s). At least one of the primary pocketbook, removably attached secondary carrier(s), and/or removable flexible strap(s), having an opening in or a loop attached to it for receiving the device for removably attaching.

The user makes use of the pocketbook system by attaching, detaching, re-attaching, exchanging, and switching different parts and/or elements to form a suitable pocketbook structure for a particular use at a particular time.

There is a need for a pocketbook system that gives the user the flexibility, ability, and choice to easily mix and match how many pocketbooks and/or other carriers and/or strap(s) will suffice for that day or evenings' use while this pocketbook system is still being easy to use and inexpensive to manufacture.

One of the objects of this device is to satisfy this need.

Figure 1:
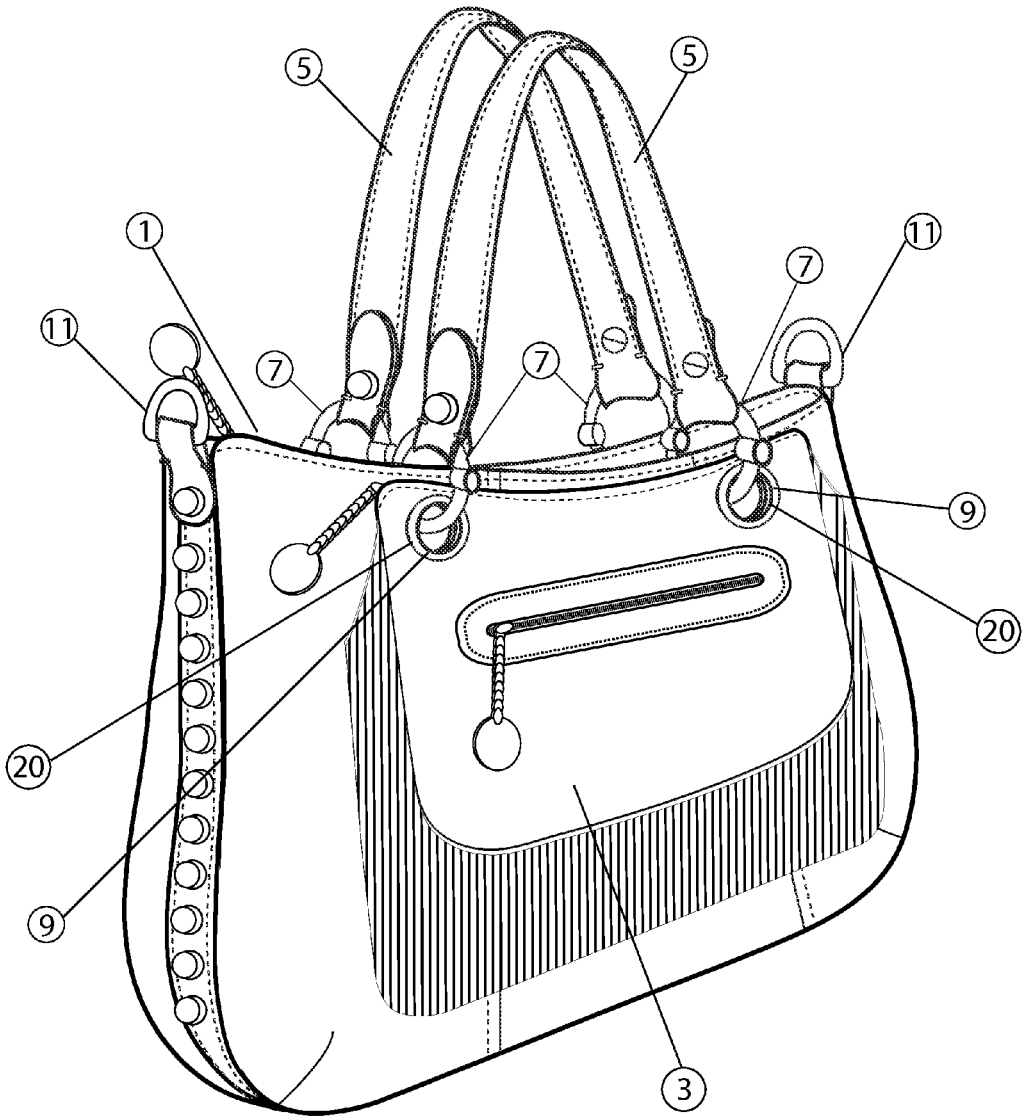
FIG. 1 depicts a primary pocketbook (1) with a removably attaching secondary carrier(s) (3) attached using a set of devices for removably attaching (7), such devices also sometimes referred to as attaching rings, which are connected through openings (9) for receiving the device(s) for removably attaching, that are on both the primary pocketbook (1) and removably attaching secondary carrier(s) (3). Additionally, the attaching rings can carry a strap (5), as shown, which is attached to this same set of devices for removably attaching (7), for the purpose to attach the strap (5) to the primary pocketbook (1) and the removably attaching secondary carrier(s) (3). Also depicted here is a second set of devices for removably attaching (7) also carrying a strap (5) (second strap) which is also attached to the second set of devices for removably attaching (7), to attach the second strap (5) to the primary pocketbook (1), and are connected through a second set of openings (9) for receiving the device for removably attaching, which openings (9) are not shown here in this figure, that are on the primary pocketbook (1). Also depicted here are loops (11) for receiving the device for removably attaching that are not being utilized for that purpose in this figure. The openings (9) for receiving the device(s) for removably attaching (7) have grommets (20) to reinforce the opening(s) (9).

This figure also depicts a removably attaching secondary carrier(s) (3), having two loops for receiving 11) the device(s) for removably attaching (7), with two device(s) for removably attaching (7) attached thereto. This shows one type of device(s) for removably attaching (7) or attaching ring (7), which opens inwardly. So the figure shows the removably attaching secondary carrier(s) (3) having attached to it a device for attaching, detaching, and re-attaching (7) comprising a circular ring (15) that has a hinge (13) in the circle so that part of the ring can be pushed inwardly to open.

The openings (9) for receiving the device(s) for removably attaching (7) have grommets (20) to reinforce the opening(s) (9).

Figure 2A:
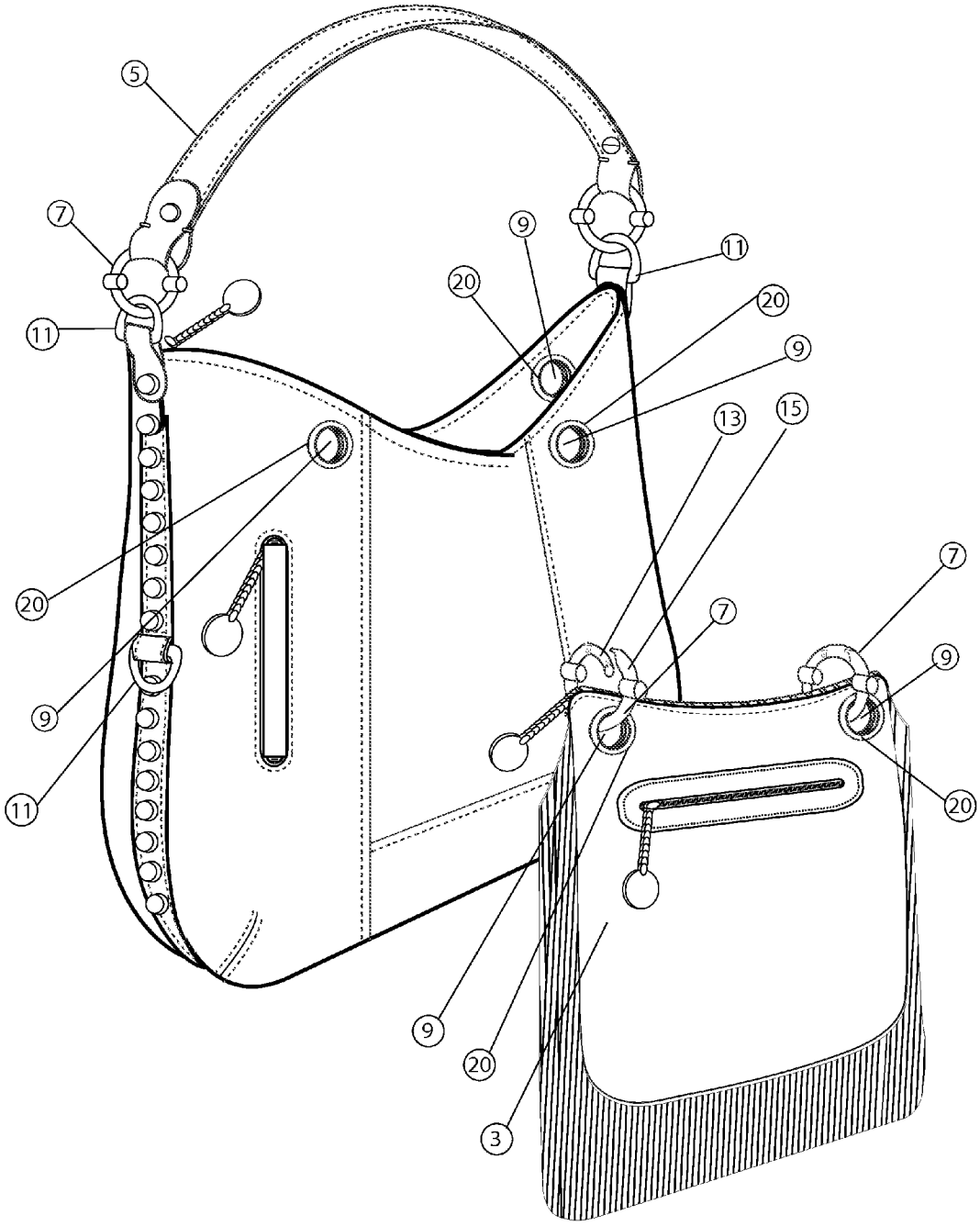
FIG. 2*a* depicts a primary pocketbook (1), having two loops (11) for receiving the device(s) for removably attaching (7), with two device(s) for removably attaching (7) attached thereto, and the device(s) for removably attaching (7) carry a strap (5) which is attached to this same set of devices for removably attaching (7), for the purpose to attach the strap (5) to the primary pocketbook (1). Also depicted on the primary pocketbook (1) is a set of holes (9) for receiving the device(s) for removably attaching (9) which are not being utilized for this purpose in this figure. The openings for receiving (9) the device(s) for removably (7) attaching have grommets (20) to reinforce the opening(s) (9).

The Extra lower loops (11) depicted on the pocketbook in FIG. 2*a* and others are attached to the pocketbook to allow attachment of the pocketbook folding over to create a different style and look.

Figure 2B:
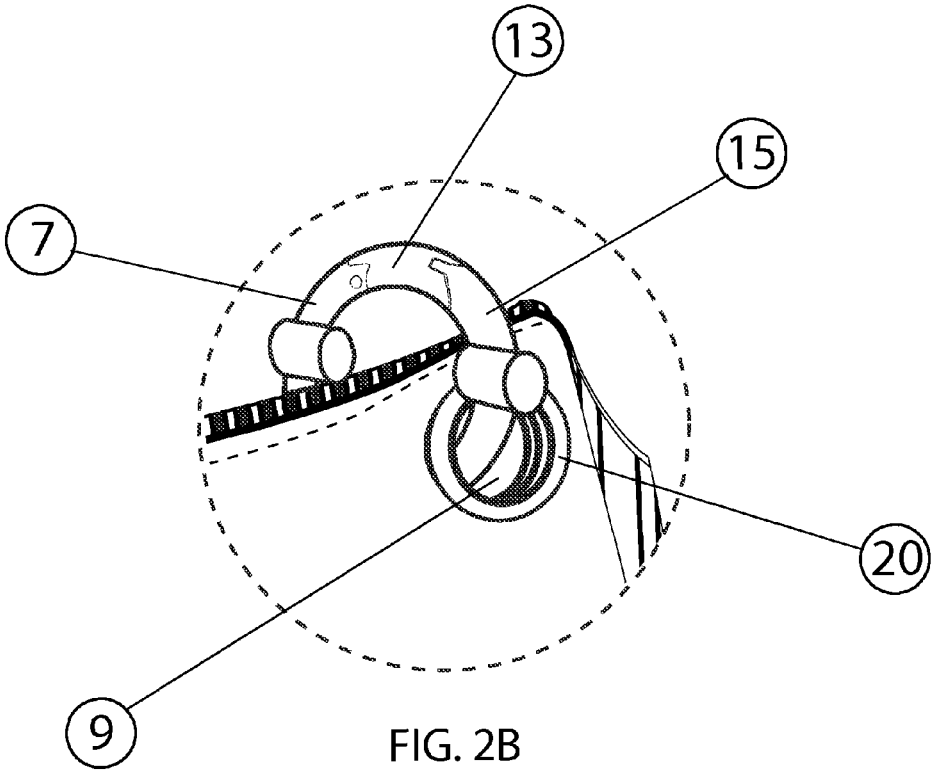
Figure 2C:
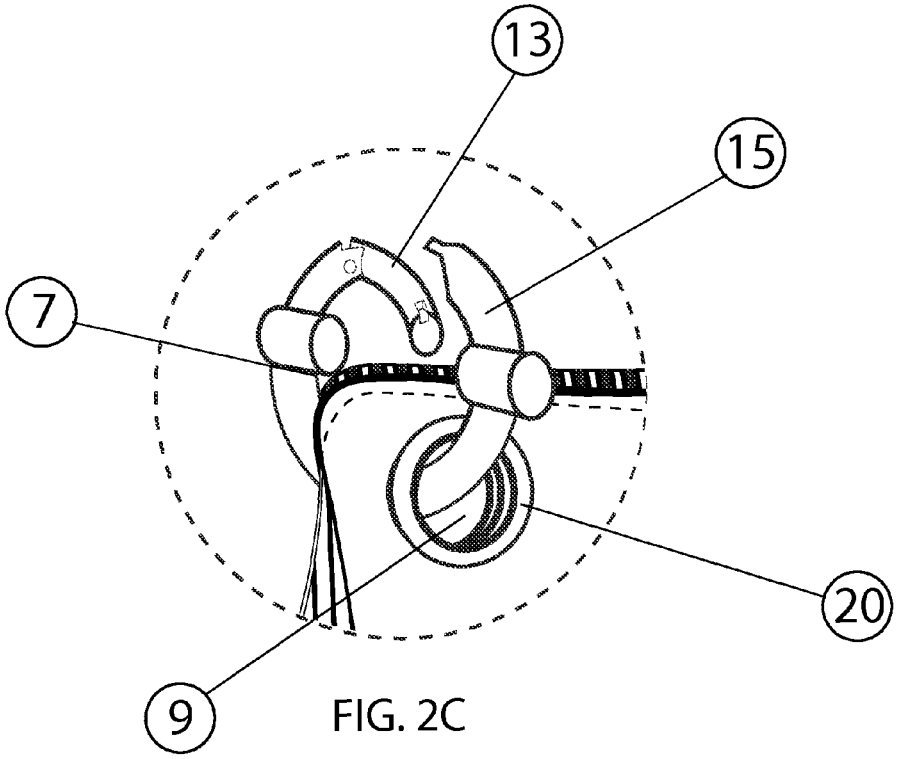

FIGS. 2*b* and 2*c* depict one type of attaching ring which opens inwardly. So the figure shows a device for attaching, detaching, and re-attaching (7) comprising a circular ring (15) that has a hinge (13) in the circle so that part of the ring can be pushed inwardly to open. In 2*b* both the hinge (13) (on both ends) and the rest of the circle (15) are connected (attached) forming a complete circle. In 2*c* the hinge (13) is pushed inwardly in the open position creating a brake in the circle (15) for attaching, detaching, re-attaching, exchanging, and switching different parts and/or elements.

Figure 3:
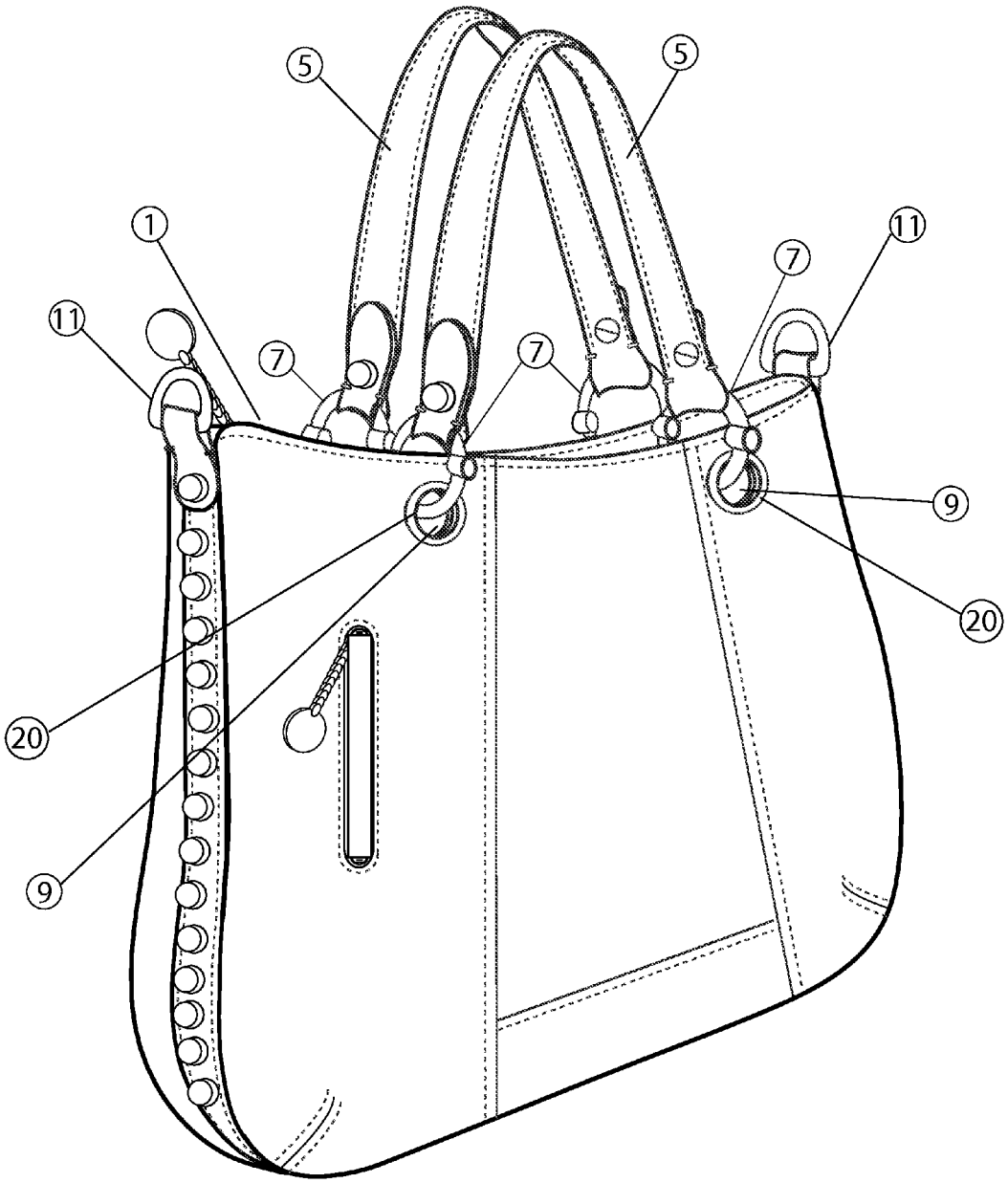

FIG. 3 depicts one version of a primary pocketbook (1) having two straps (5).

This figure includes a primary pocketbook (1), two removable flexible strap(s) (5), and four device(s) (two sets of two) for removably attaching (7) carrying the removable flexible strap(s) (5) and attached to the primary pocketbook (1). The primary pocketbook (1) having four openings (9) in the primary pocketbook (1) (two sets of two), for receiving the device for removably attaching (7) and the primary pocketbook (1) having two loops for receiving (11) the device for removably attaching (7) that are not be utilized for that function in this figure. The openings (9) for receiving the device(s) for removably attaching (7) have grommets (20) to reinforce the opening(s) (9).

Figure 4:
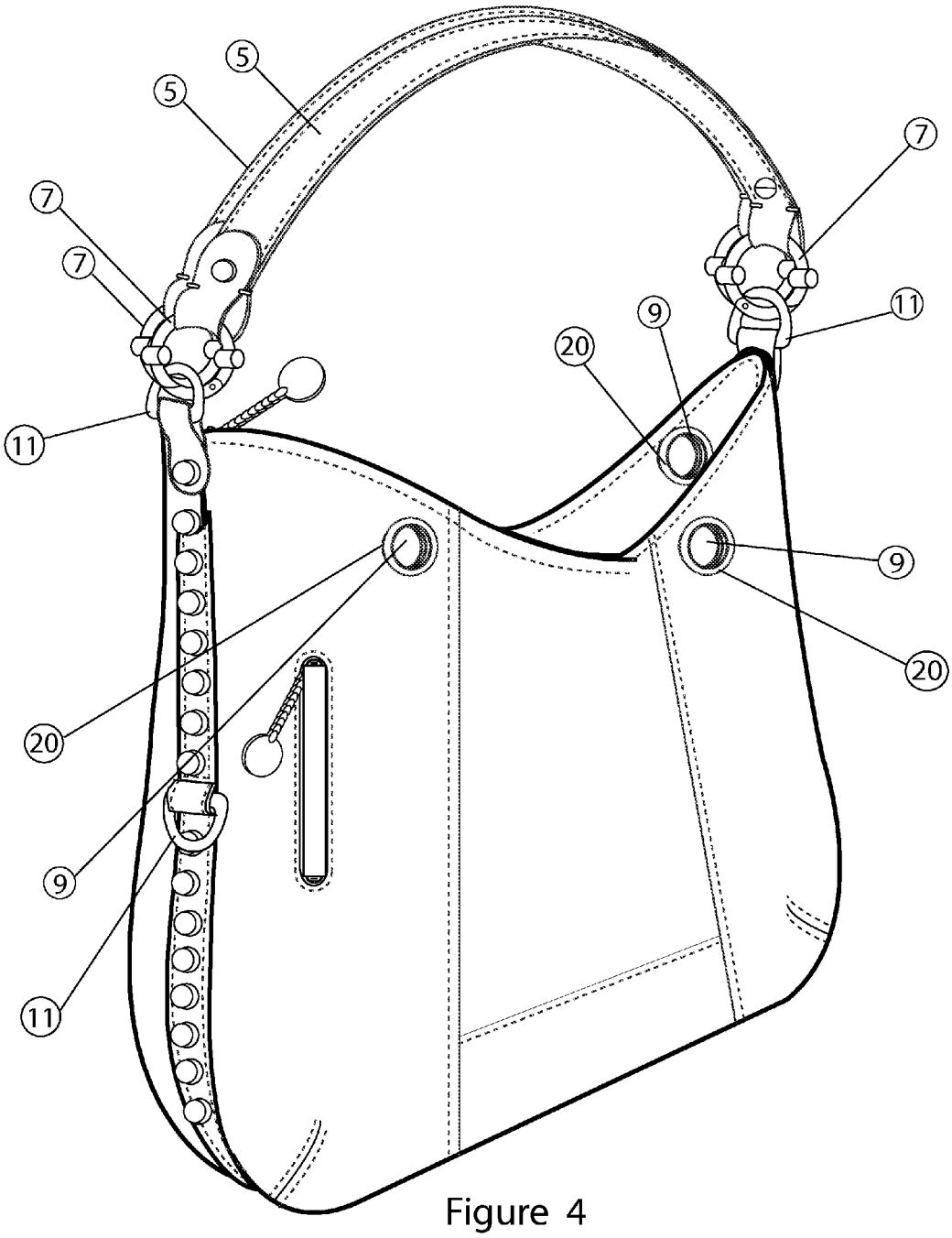

FIG. 4 shows another version of a primary pocketbook (1), having two loops (11) for receiving the device(s) for removably attaching (7), with four device(s) for removably attaching (7) (two sets of two) attached thereto, and each set of two device(s) for removably attaching (7) carry a strap (5) which is attached to this same set of devices for removably attaching (7), for the purpose to attach the strap (5) to the primary pocketbook (1) (two straps). The primary pocketbook (1) having two loops (11) on the primary pocketbook (1), for receiving the device for removably attaching (7) and the primary pocketbook (1) having four holes in (9) (only 3 shown) for receiving the device for removably attaching (7) that are not being utilized for that function in this figure.

The openings (9) for receiving the device(s) for removably attaching (7) have grommets (20) to reinforce the opening(s) (9).

Figure 5:
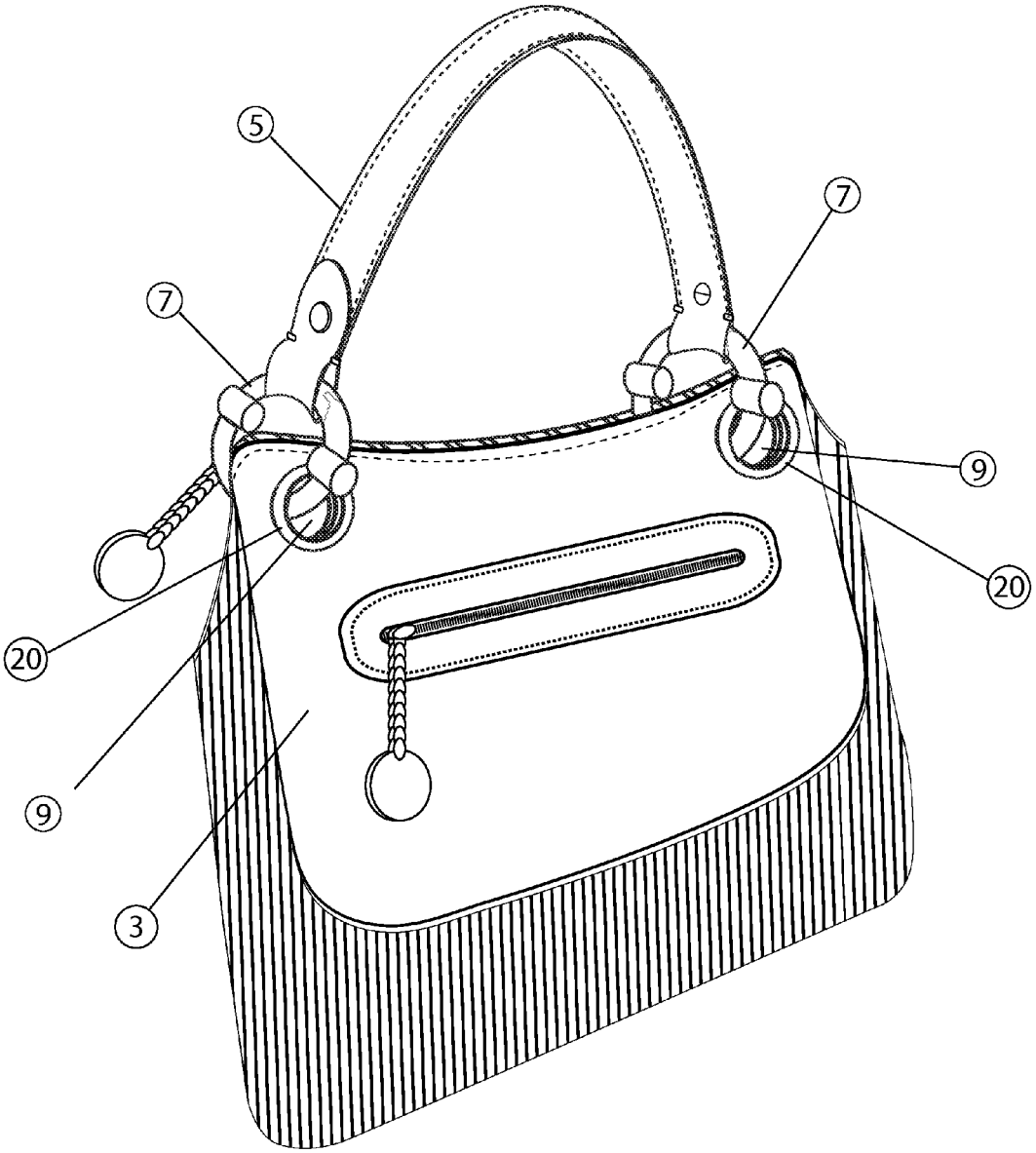

FIG. 5 depicts a version of a removably attaching secondary carrier(s) (3) having a strap (5).

This figure includes a removably attaching secondary carrier(s) (3), a removable flexible strap(s) (5), And two device(s) for removably attaching (7) carrying the removable flexible strap(s) (5) and attached to a removably attaching secondary carrier(s) (3). The removably attaching secondary carrier(s) (3) having four openings in (9) a removably attaching secondary carrier(s) (3) (two sets of two), for receiving the device for removably attaching (7) (only two are shown).

The openings (9) for receiving the device(s) for removably attaching (7) have grommets (20) to reinforce the opening(s) (9).

Figure 6:
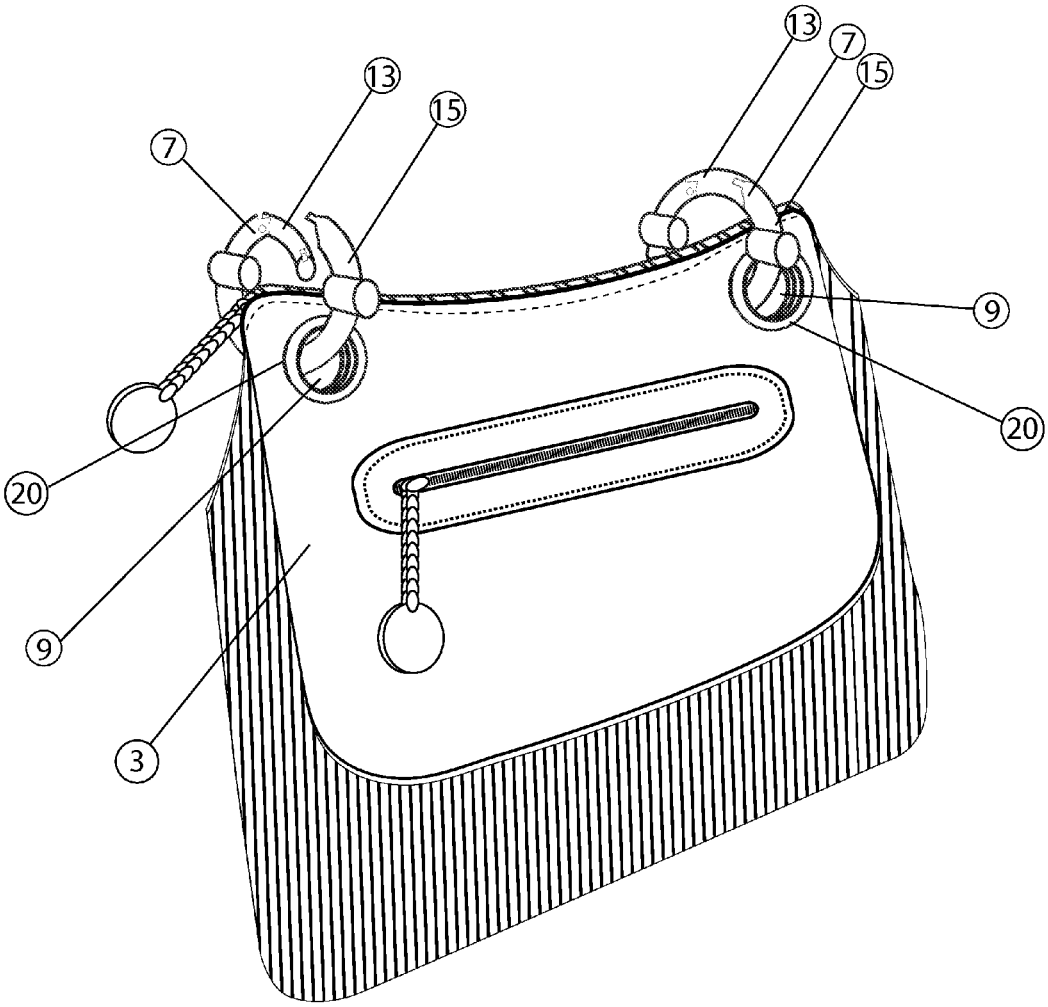

FIG. 6 shows the primary pocketbook (1) having one example of a mechanism for attaching, detaching, and re-attaching (7) the straps (5) or the removably attaching secondary carrier(s) (3).

This figure includes a primary pocketbook (1), and two device(s) for removably attaching (7), and the primary pocketbook (1) having two openings in (9) the primary pocketbook (1), for receiving the device for removably attaching (7).

This shows one type of device(s) for removably attaching (7) or attaching ring (7), which opens inwardly. So the figure shows the primary pocketbook (1) having attached to it two devices for attaching, detaching, and re-attaching (7) comprising a circular ring (15) that has a hinge (13) in the circle (15) so that part of the ring can be pushed inwardly to open.

The openings (9) for receiving the device(s) for removably attaching (7) have grommets (20) to reinforce the opening(s) (9).

Figure 7:
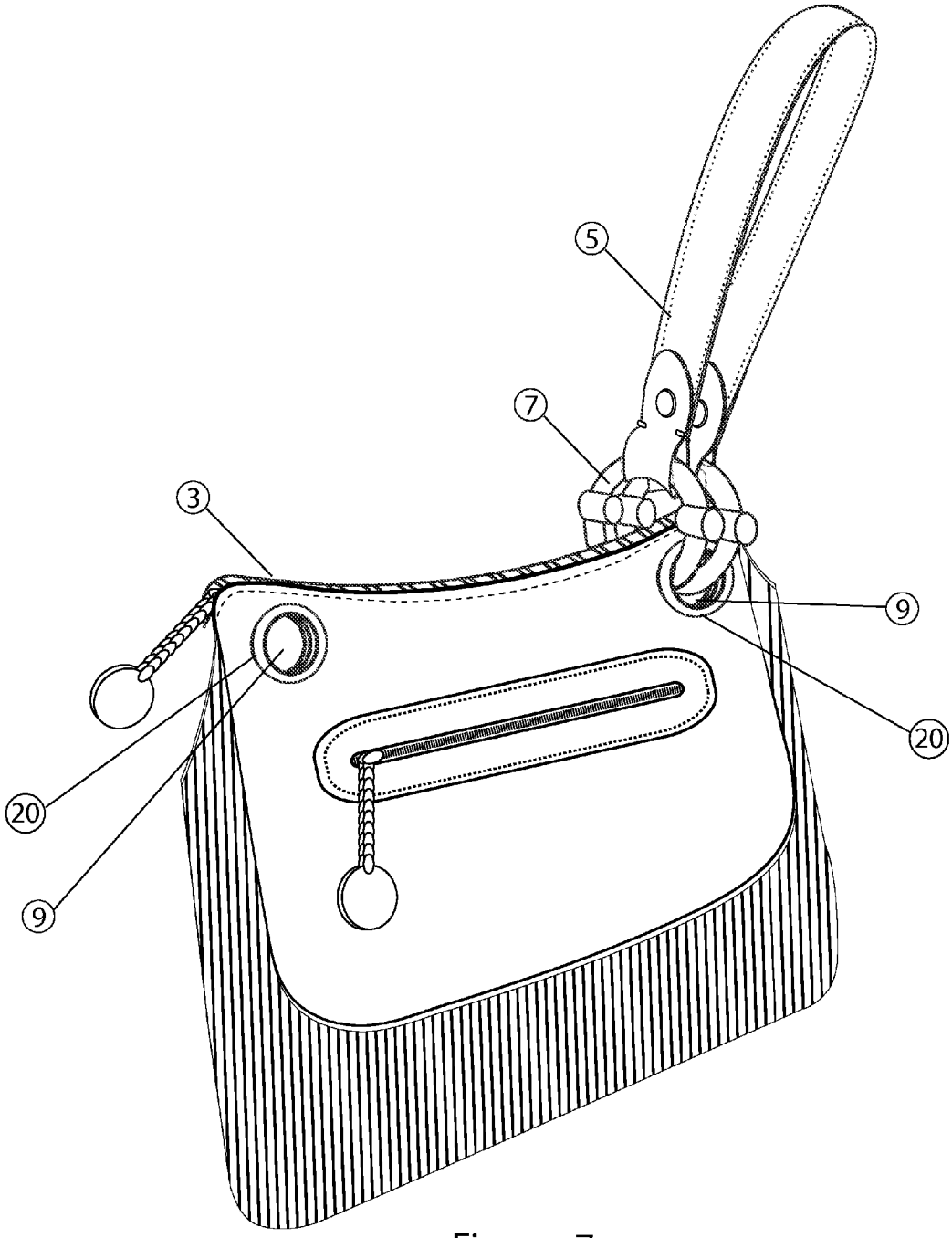

FIG. 7 depicts a version of a removably attaching secondary carrier(s) (3) having a wrist strap (5). A wrist strap is sized and shaped so it can be hand held or worn on one's wrist.

This figure includes a removably attaching secondary carrier(s) (3), a removable flexible strap(s) (5), and two device(s) for removably attaching (7) carrying the removable flexible strap(s) (5) and attached to a removably attaching secondary carrier(s) (3). The removably attaching secondary carrier(s) (3) having four openings in (9) the removably attaching secondary carrier(s) (3) (two sets of two), for receiving the device for removably attaching (7) (only two are shown). Only one of the openings (9) is being used in this figure to attach to both device(s) for removably attaching (7).

The openings (9) for receiving the device(s) for removably attaching (7) have grommets (20) to reinforce the opening(s) (9).

Figure 8:
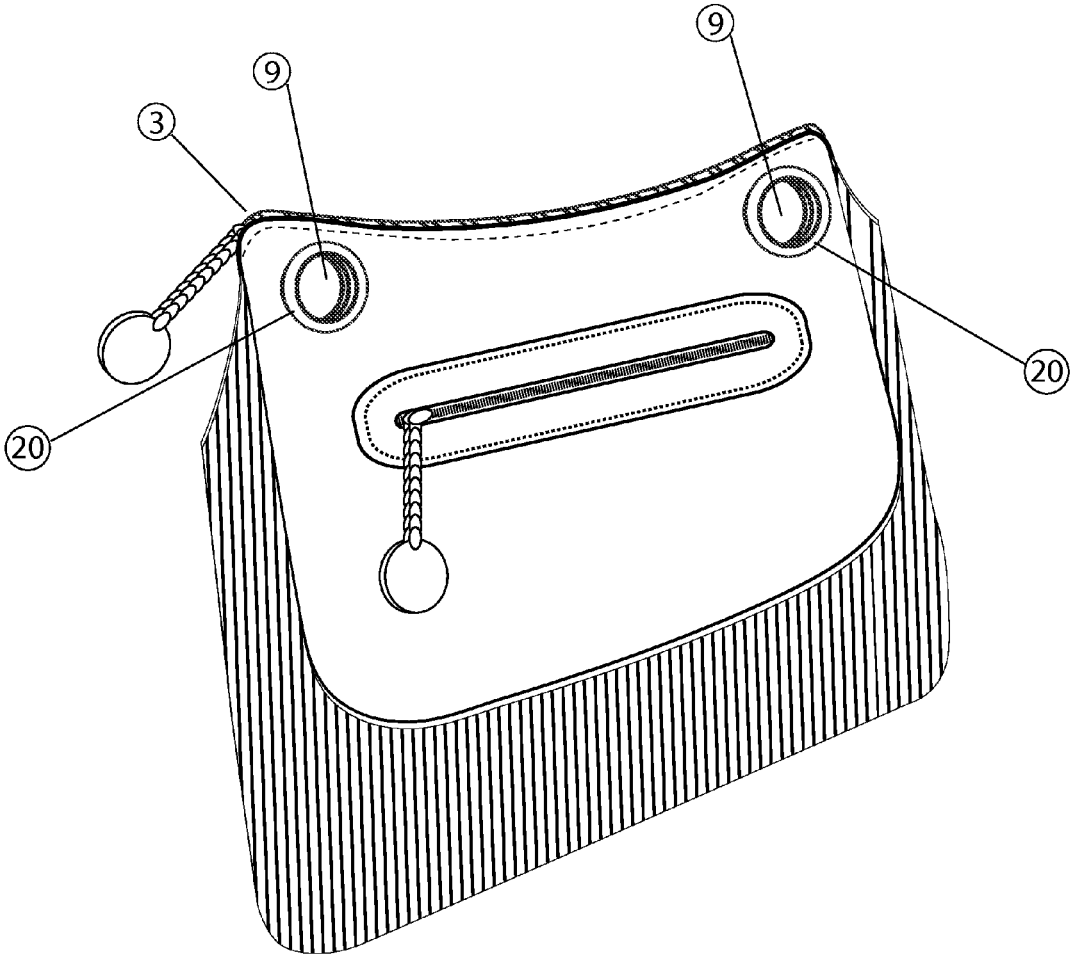

FIG. 8 shows a version of a removably attaching secondary carrier(s) (3) in the form of a clutch.

This figure includes a removably attaching secondary carrier(s) (3). The removably attaching secondary carrier(s) (3) having four openings (9) in the removably attaching secondary carrier(s) (3) (two sets of two), for receiving the device for removably attaching (7) (only two "holes in" are shown).

The openings (9) for receiving the device(s) for removably attaching (7) have grommets (20) to reinforce the opening(s) (9).

Figure 9:
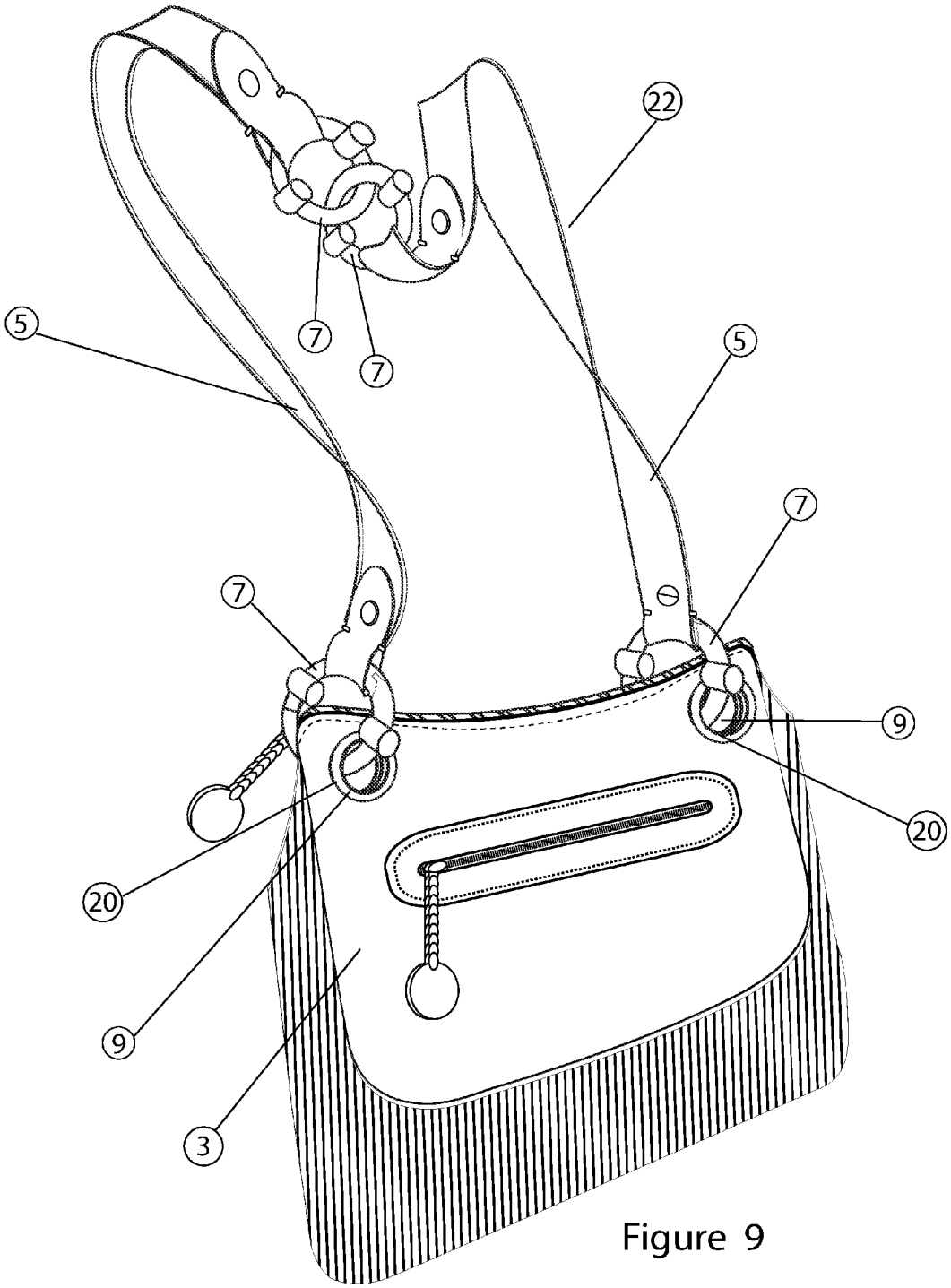

FIG. 9 shows a version of a removably attaching secondary carrier(s) (3) having two straps (5) connected together to form one long strap (22); this can be used to carry the pocketbook across the wearer's body.

This figure includes a removably attaching secondary carrier(s) (3), two removable flexible strap(s) (5), and four device(s) for removably attaching (7) (two sets of two) carrying the removable flexible strap(s) (5. The removably attaching secondary carrier(s) (3) having four openings in (9) the removably attaching secondary carrier(s) (3) (two sets of two), for receiving the device for removably attaching (7) (only two openings (9) are shown). The two straps (5) are both joined at one end to the removably attaching secondary carrier(s) (3) by a device(s) for removably attaching (7) and joined together like links of a chain at the other end by a device(s) for removably attaching (7) to form one longer strap (22).

The openings (9) for receiving the device(s) for removably attaching (7) have grommets (20) to reinforce the opening(s) (9).

Figure 10:
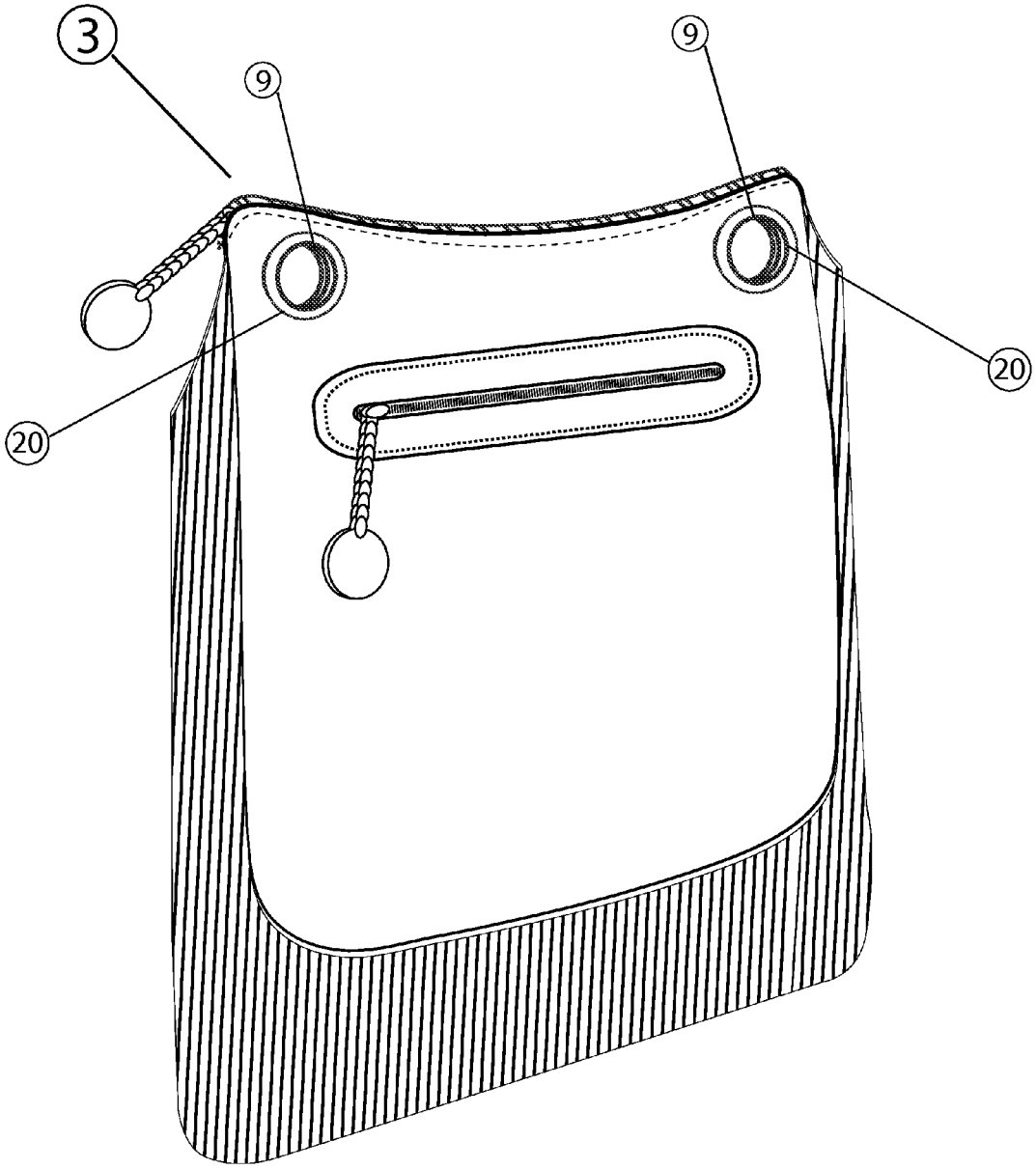
Figure 11:
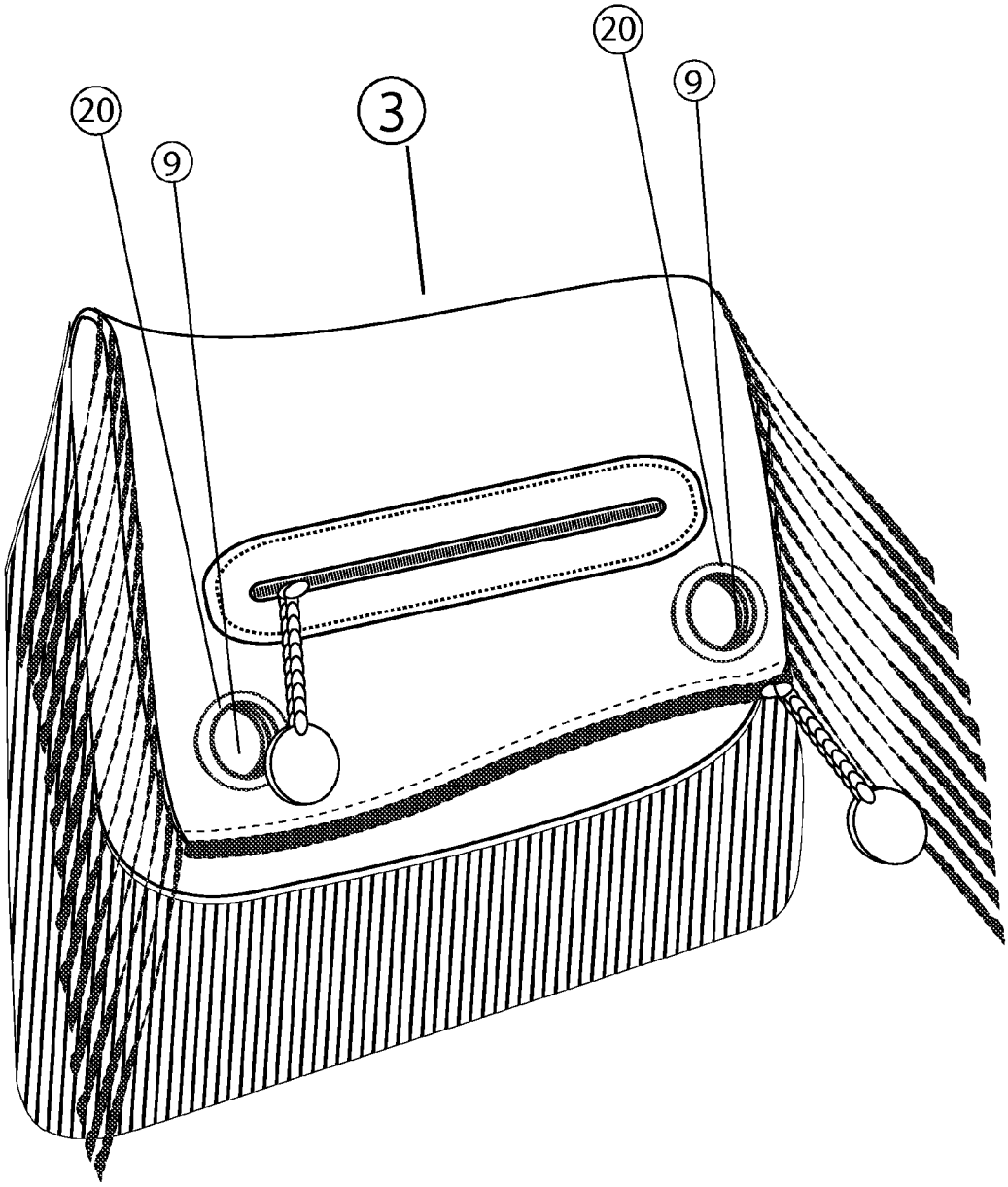

FIGS. 10 and 11 show two versions of a removably attaching secondary carrier(s) (3).

Both FIG. 10 and FIG. 11 include a different type of styles of a removably attaching secondary carrier(s) (3). The removably attaching secondary carrier(s) (3) having two openings in (9) a removably attaching secondary carrier(s) (3), for receiving the device for removably attaching (7).

In FIG. 10, the removably attaching secondary carrier(s) (3) forms a clutch (style of pocketbook) and in FIG. 11, the removably attaching secondary carrier(s) (3) forms a fold-over clutch (style of pocketbook), having the top folded over.

In both FIGS. 10 and 11 the openings (9) for receiving the device(s) for removably attaching (7) have grommets (20) to reinforce the opening(s) (9).

Figure 12:
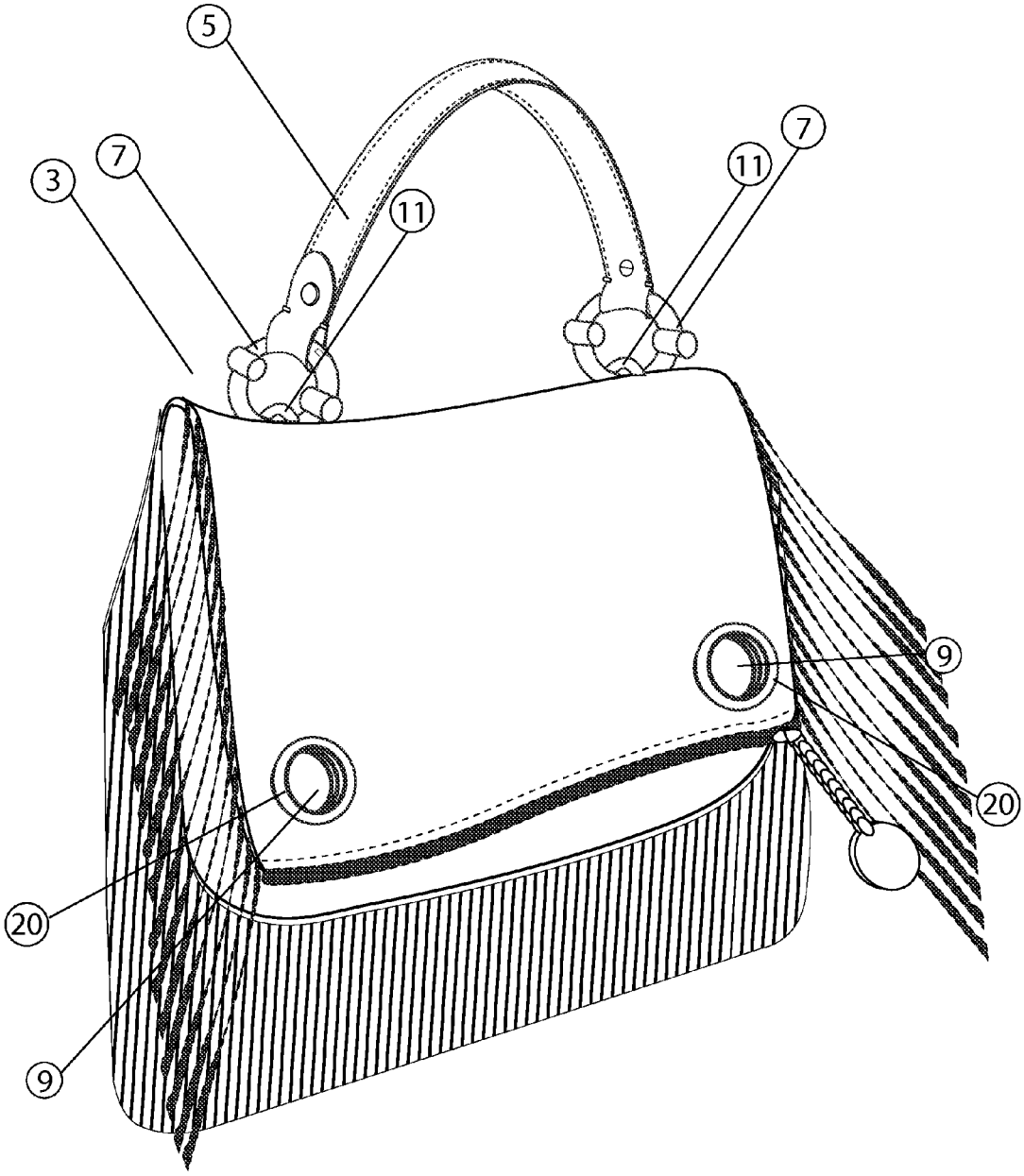

FIG. 12 shows the fold-over clutch (3) style of pocketbook, which is a removably attaching secondary carrier(s) (3) attached to a strap (5).

This figure includes a removably attaching secondary carrier(s) (3), a removable flexible strap(s) (5), And two device(s) for removably attaching (7) carrying the removable flexible strap(s) (5) and attaching the strap (5) to the removably attached secondary carrier(s) (3) The removably attached secondary carrier(s) (3) having two loops on (11) the removably attached secondary carrier(s) (3), for receiving the device for removably attaching (7) and the removably attached secondary carrier(s) (3) and having two holes in (9) for receiving the device for removably attaching (7) that are not be utilized for that function in this figure.

The openings (9) for receiving the device(s) for removably attaching (7) have grommets (20) to reinforce the opening(s) (9).

Figure 13:
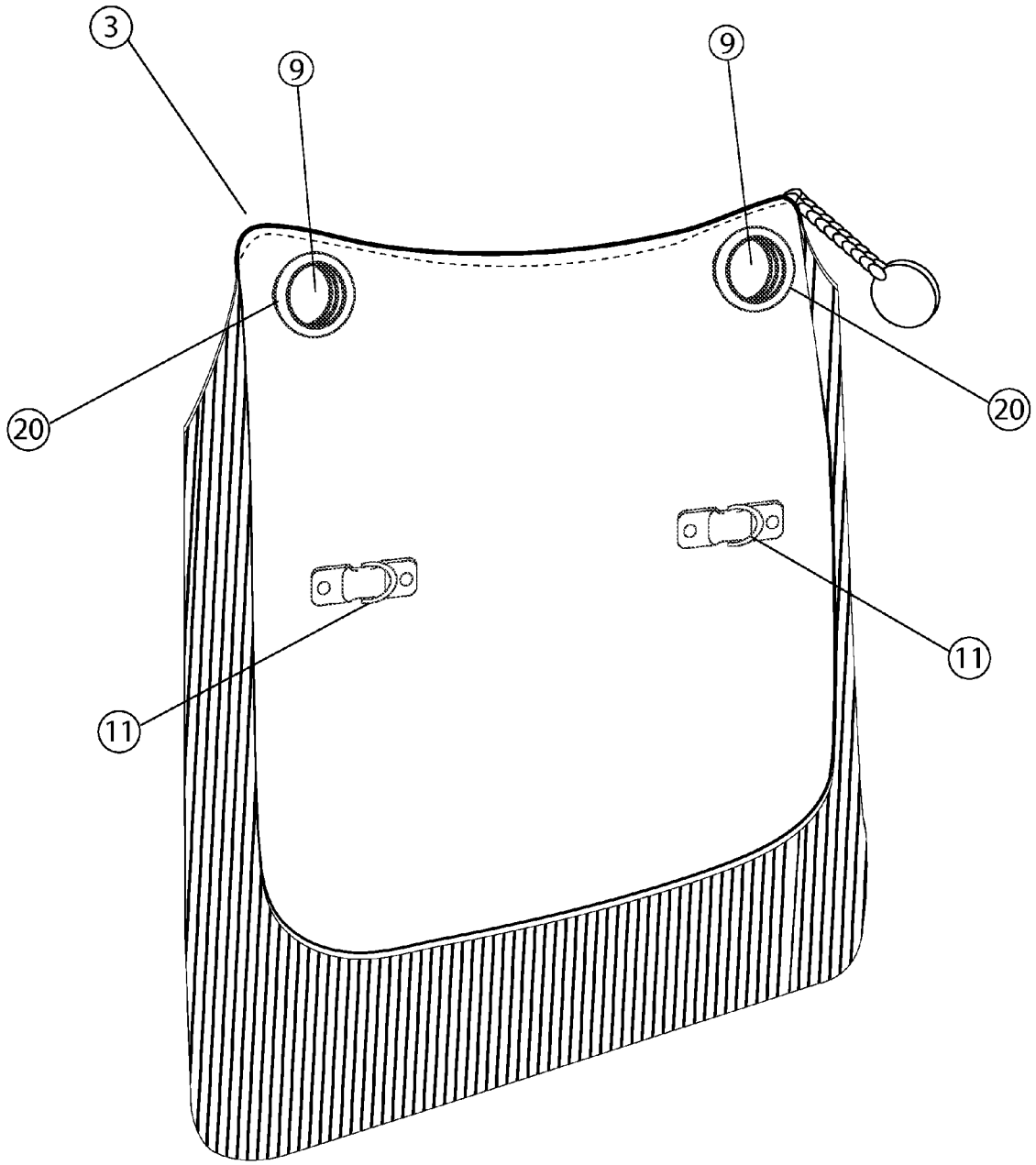

FIG. 13 shows an example of the attachment points for the strap (5) in the fold-over clutch (3) of FIG. 12.

This figure includes a removably attaching secondary carrier(s) (3), and the removably attached secondary carrier(s) (3) having two loops on (11) the removably attached secondary carrier(s) (3), for receiving the device for removably attaching (7) and the removably attached secondary carrier(s) (3) and having two holes or openings in (9) it for receiving the device for removably attaching (7).

The openings (9) for receiving the device(s) for removably attaching (7) have grommets (20) to reinforce the opening(s) (9).

Figure 14:
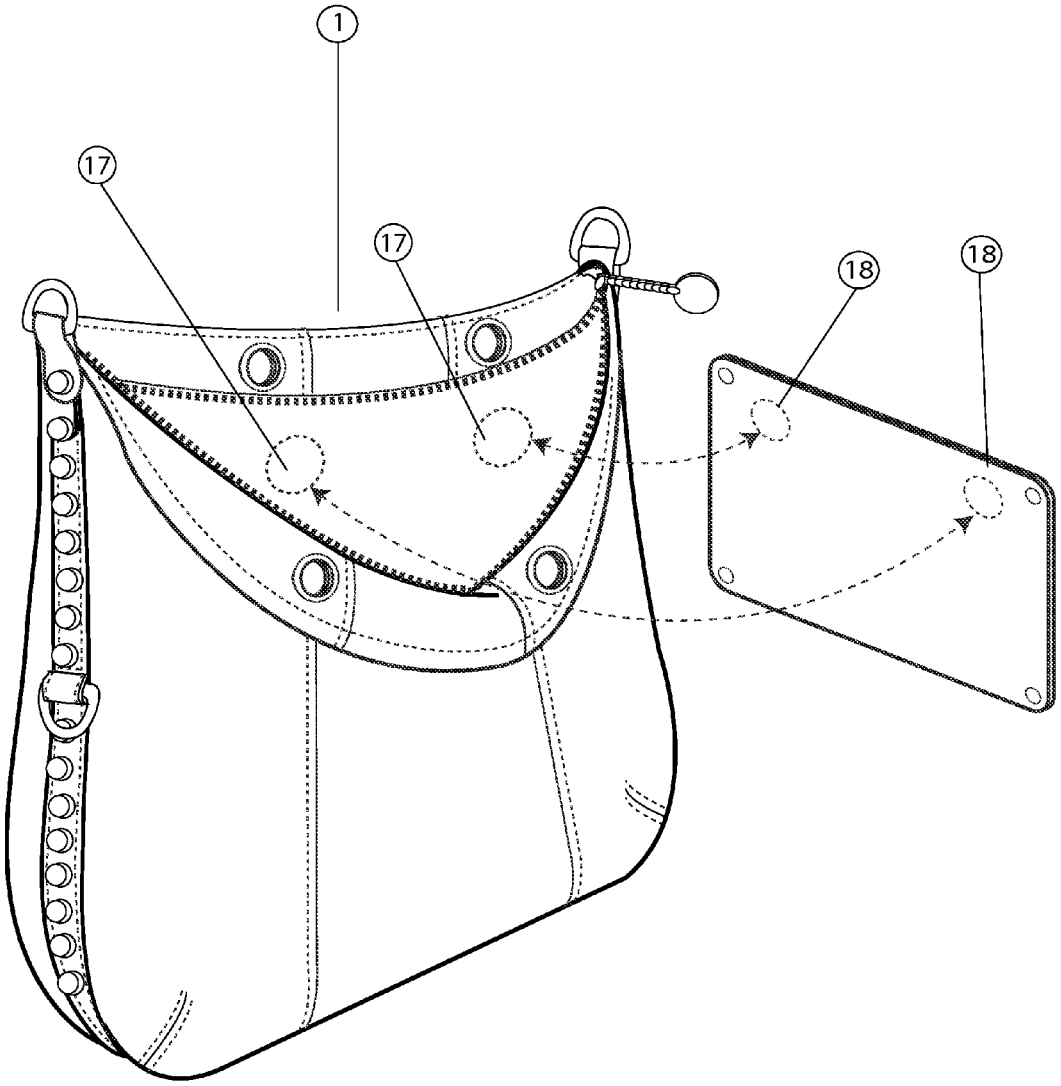
Figure 15:
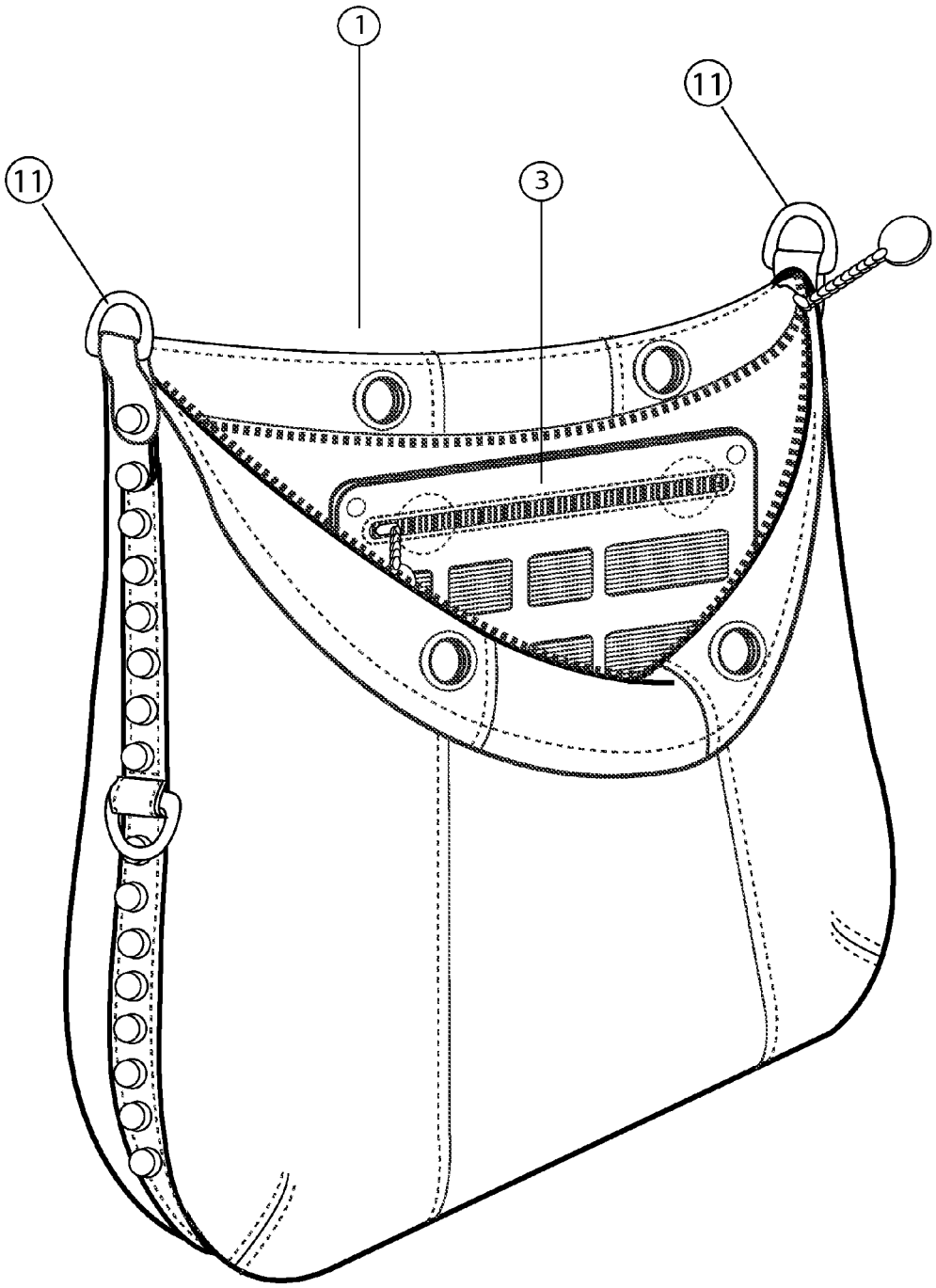

FIGS. 14 and 15—The figure shows a primary pocketbook (1) having, for example, two points of attachment (17) for an inside attached removably attached secondary carrier(s) (3). In the figure, the removably attached secondary carrier(s) (3) has, for example, two points of attachment (18) for the primary pocketbook (1) and several slits for carrying lipsticks, other makeup, perfumes, etc. The points of attachment are depicted in the figure as magnets, in male (18) or female (17) form on the primary pocketbook (1), which attach to corresponding male (18) or female (17) magnets on the removably attached secondary carrier(s) (3). Although the figure shows two points of attachment on the primary pocketbook (1) and the removably attached secondary carrier(s) (3), there only needs to be one and there can be two or more points of attachment. Also, although the figure shows the points of attachment being on the inside of the primary pocketbook (1), they can also or instead be on the outside of the primary pocketbook (1).

The pocketbook system shown here in FIG. 14 has two device(s) for removably attaching on the primary pocketbook and on the removably attached secondary carrier(s), both having two device(s) for removably attaching which are magnets, in male or female form which devices(s) further comprising a fabric material to conceal and completely cover-up the devices.

DETAILED DESCRIPTION OF THE DRAWINGS

FIG. 1 depicts a primary pocketbook (1) with a removably attaching secondary carrier(s) (3) attached using a set of devices for removably attaching (7), such devices also sometimes referred to as attaching rings, which are connected through openings (9) for receiving the device(s) for removably attaching, that are on both the primary pocketbook (1) and removably attaching secondary carrier(s) (3). Additionally, the attaching rings carry a strap (5) which is attached to this same set of devices for removably attaching (7), for the purpose to attach the strap (5) to the primary pocketbook (1) and the removably attaching secondary carrier(s) (3). Also depicted here is a second set of devices for removably attaching (7) also carrying a strap (5) (second strap) which is also attached to the second set of devices for removably attaching (7), to attach the second strap (5) to the primary pocketbook (1), and are connected through a second set of openings (9) for receiving the device for removably attaching, which openings (9) are not shown here in this figure, that are on the primary pocketbook (1). Also depicted here are loops (11) for receiving the device for removably attaching that are not being utilized for that purpose in this figure. The openings (9) for receiving the device(s) for removably attaching (7) have grommets (20) to reinforce the opening(s) (9).

FIG. 2*a* depicts a primary pocketbook (1), having two loops (11) for receiving the device(s) for removably attaching (7), with two device(s) for removably attaching (7) attached thereto, and the device(s) for removably attaching (7) carry a strap (5) which is attached to this same set of devices for removably attaching (7), for the purpose to attach the strap (5) to the primary pocketbook (1). Also depicted on the primary pocketbook (1) is a set of holes (9) for receiving the device(s) for removably attaching (9) which are not being utilized for this purpose in this figure. The openings for receiving (9) the device(s) for removably (7) attaching have grommets (20) to reinforce the opening(s) (9).

This figure also depicts a removably attaching secondary carrier(s) (3), having two loops for receiving (11) the device(s) for removably attaching (7), with two device(s) for removably attaching (7) attached thereto. This shows one type of device(s) for removably attaching (7) or attaching ring (7), which opens inwardly. So the figure shows the removably attaching secondary carrier(s) (3) having attached to it a device for attaching, detaching, and re-attaching (7) comprising a circular ring (15) that has a hinge (13) in the circle so that part of the ring can be pushed inwardly to open.

The openings (9) for receiving the device(s) for removably attaching (7) have grommets (20) to reinforce the opening(s) (9).

The Extra lower loops (11) depicted on the pocketbook in FIG. 2*a* and others are attached to the pocketbook to allow attachment of the pocketbook folding over to create a different style and look.

FIGS. 2*b* and 2*c* depict one type of attaching ring which opens inwardly. So the figure shows a device for attaching, detaching, and re-attaching (7) comprising a circular ring (15) that has a hinge (13) in the circle so that part of the ring can be pushed inwardly to open. In 2*b* both the hinge (13) (on both ends) and the rest of the circle (15) are connected (attached) forming a complete circle. In 2*c* the hinge (13) is pushed inwardly in the open position creating a brake in the circle (15) for attaching, detaching, re-attaching, exchanging, and switching different parts and/or elements.

FIG. 3 depicts one version of a primary pocketbook (1) having two straps (5).

This figure includes a primary pocketbook (1), Two removable flexible strap(s) (5), And four device(s) (two sets of two) for removably attaching (7) carrying the removable flexible strap(s) (5) and attached to the primary pocketbook (1). The primary pocketbook (1) having four openings (9) in the primary pocketbook (1) (two sets of two), for receiving the device for removably attaching (7) and the primary pocketbook (1) having two loops for receiving (11) the device for removably attaching (7) that are not being utilized for that function in this figure. The openings (9) for receiving the device(s) for removably attaching (7) have grommets (20) to reinforce the opening(s) (9).

FIG. 4 shows another version of a primary pocketbook (1), having two loops (11) for receiving the device(s) for removably attaching (7), with four device(s) for removably attaching (7) (two sets of two) attached thereto, and each set of two device(s) for removably attaching (7) carry a strap (5) which is attached to this same set of devices for removably attaching (7), for the purpose to attach the strap (5) to the primary pocketbook (1) (two straps).

The primary pocketbook (1) having two loops (11) on the primary pocketbook (1), for receiving the device for removably attaching (7) and the primary pocketbook (1) having four holes in (9) (only 3 shown) for receiving the device for removably attaching (7) that are not be utilized for that function in this figure.

The openings (9) for receiving the device(s) for removably attaching (7) have grommets (20) to reinforce the opening(s) (9).

FIG. 5 depicts a version of a removably attaching secondary carrier(s) (3) having a strap (5).

This figure includes a removably attaching secondary carrier(s) (3), a removable flexible strap(s) (5), And two device(s) for removably attaching (7) carrying the removable flexible strap(s) (5) and attached to a removably attaching secondary carrier(s) (3). The removably attaching secondary carrier(s) (3) having four openings in (9) the removably attaching secondary carrier(s) (3) (two sets of two), for receiving the device for removably attaching (7) (only two are shown).

The openings (9) for receiving the device(s) for removably attaching (7) have grommets (20) to reinforce the opening(s) (9).

FIG. 6 shows the primary pocketbook (1) having one example of a mechanism for attaching, detaching, and re-attaching (7) the straps (5) or the removably attaching secondary carrier(s) (3).

This figure includes a primary pocketbook (1), and two device(s) for removably attaching (7), and the primary pocketbook (1) having two openings in (9) the primary pocketbook (1), for receiving the device for removably attaching (7).

This shows one type of device(s) for removably attaching (7) or attaching ring (7), which opens inwardly. So the figure shows the primary pocketbook (1) having attached to it two devices for attaching, detaching, and re-attaching (7) comprising a circular ring (15) that has a hinge (13) in the circle (15) so that part of the ring can be pushed inwardly to open.

The openings (9) for receiving the device(s) for removably attaching (7) have grommets (20) to reinforce the opening(s) (9).

FIG. 7 depicts a version of a removably attaching secondary carrier(s) (3) having a wrist strap (5). A wrist strap is sized and shaped so it can be hand held or worn on one's wrist.

This figure includes a removably attaching secondary carrier(s) (3), a removable flexible strap(s) (5), And two device(s) for removably attaching (7) carrying the removable flexible strap(s) (5) and attached to a removably attaching secondary carrier(s) (3). The removably attaching secondary carrier(s) (3) having four openings in (9) the removably attaching secondary carrier(s) (3) (two sets of two), for receiving the device for removably attaching (7) (only two are shown). Only one of the openings (9) is being used in this figure to attach to both device(s) for removably attaching (7).

The openings (9) for receiving the device(s) for removably attaching (7) have grommets (20) to reinforce the opening(s) (9).

FIG. 8 shows a version of a removably attaching secondary carrier(s) (3) in the form of a clutch.

This figure includes a removably attaching secondary carrier(s) (3), and a removably attaching secondary carrier(s) (3) having four openings (9) in the removably attaching secondary carrier(s) (3) (two sets of two), for receiving the device for removably attaching (7) (only two "holes in" are shown).

The openings (9) for receiving the device(s) for removably attaching (7) have grommets (20) to reinforce the opening(s) (9).

FIG. 9 shows a version of a removably attaching secondary carrier(s) (3) having two straps (5) connected together to form one long strap (22); this can be used to carry the secondary carrier across the wearer's body.

This figure includes a removably attaching secondary carrier(s) (3), two removable flexible strap(s) (5), And four device(s) for removably attaching (7) (two sets of two) carrying the removable flexible strap(s) (5), and the removably attaching secondary carrier(s) (3) having four openings in (9) the removably attaching secondary carrier(s) (3) (two sets of two), for receiving the device for removably attaching (7) (only two openings (9) are shown). The two straps (5) are both joined at one end to the removably attaching secondary carrier(s) (3) by a device(s) for removably attaching (7) and joined together like links of a chain at the other end by a device(s) for removably attaching (7) to form one longer strap (22).

The openings (9) for receiving the device(s) for removably attaching (7) have grommets (20) to reinforce the opening(s) (9).

FIGS. 10 and 11 show two versions of a removably attaching secondary carrier(s) (3).

Both FIG. 10 and FIG. 11 include a different type of styles of a removably attaching secondary carrier(s) (3), and the removably attaching secondary carrier(s) (3) having two openings in (9) the removably attaching secondary carrier(s) (3), for receiving the device for removably attaching (7).

In FIG. 10, the removably attaching secondary carrier(s) (3) forms a clutch (style of pocketbook) and in FIG. 11, the removably attaching secondary carrier(s) (3) forms a fold-over clutch (style of pocketbook), having the top folded over.

In both FIGS. 10 and 11 the openings (9) for receiving the device(s) for removably attaching (7) have grommets (20) to reinforce the opening(s) (9).

FIG. 12 shows the fold-over clutch (3) style of pocketbook, which is a removably attaching secondary carrier(s) (3) attached to a strap (5).

This figure includes a removably attaching secondary carrier(s) (3), a removable flexible strap(s) (5), And two device(s) for removably attaching (7) carrying the removable flexible strap(s) (5) and attaching the strap (5) to the removably attached secondary carrier(s) (3), and the removably attached secondary carrier(s) (3) having two loops (11) on the removably attached secondary carrier(s) (3), for receiving the device for removably attaching (7). The removably attached secondary carrier(s) (3) having two holes (9) in for receiving the device for removably attaching (7) that are not being utilized for that function in this figure.

The openings (9) for receiving the device(s) for removably attaching (7) have grommets (20) to reinforce the opening(s) (9).

FIG. 13 shows an example of the attachments points for the strap (5) in the fold-over clutch (3) of FIG. 12.

This figure includes a removably attaching secondary carrier(s) (3), and the removably attached secondary carrier(s) (3) having two loops (11) on the removably attached secondary carrier(s) (3), for receiving the device for removably attaching (7) and the removably attached secondary carrier(s) (3) and having two holes (9) in it for receiving the device for removably attaching (7).

The openings (9) for receiving the device(s) for removably attaching (7) have grommets (20) to reinforce the opening(s) (9).

FIGS. 14 and 15—The figures show a primary pocketbook (1) having, for example, two points of attachment (17) for an inside attached removably attached secondary carrier(s) (3). In the figure, the removably attached secondary carrier(s) (3) has, for example, two points of attachment (18) for the primary pocketbook (1) and several slits for carrying lipsticks, other makeup, perfumes, etc. The points of attachment are depicted in the figure as magnets, in male (18) or female (17) form on the primary pocketbook (1), which attach to corresponding male (18) or female (17) magnets on the removably attached secondary carrier(s) (3). Although the figure shows two points of attachment on the primary pocketbook (1) and the removably attached secondary carrier(s) (3), there only needs to be one and there can be two or more points of attachment. Also, although the figure shows the points of attachment being on the inside of the primary pocketbook (1), they can also or instead be on the outside of the primary pocketbook (1).

The pocketbook system shown here in FIG. 14 has two device(s) for removably attaching on the primary pocketbook and on the removably attached secondary carrier(s), both having two device(s) for removably attaching which are magnets, in male or female form which devices(s) further comprising a fabric material to conceal and completely cover-up the devices.

DETAILED DESCRIPTION OF THE INVENTION

A pocketbook system that gives the user the flexibility and choice to easily mix and match how many pocketbooks and/or other carriers and/or strap(s) will suffice for that day or evenings' use while this pocketbook system is still being easy to use and inexpensive to manufacture.

This pocketbook system comprises at least one primary pocketbook for carrying certain contents, and one or more removably attached secondary carrier(s) for carrying certain contents, they are removably attached by at least one device(s) for removably attaching the secondary carrier(s) to the inside or outside of the primary pocketbook, and at least one of the primary pocketbook and/or the removably attached secondary carrier(s) having an opening or a loop for receiving the device for removably attaching. The primary pocketbook can be comprised of at least one of a tote, pouch, purse, handbag, pocketbook, or clutch. The removably attached secondary carrier(s) can be comprised of at least one of a tote, pouch, purse, handbag, pocketbook, clutch, wallet, cellphone case, organizer, make-up case, or eyewear case. The removably attached secondary carrier(s) can be used for carrying certain of the contents of a pocketbook in or on the removably attached secondary carrier(s) alone. The removably attached secondary carrier(s) can be a secondary pocketbook, which is the same or different from the primary pocketbook, having one or more openings, slits or pockets, for carrying certain of the contents of a pocketbook. There can be at least two or more devices for removably attaching. The removably attached secondary carrier(s) can have any combination of large and small openings for holding or fastening any type of accessory or contents that could be carried in a pocketbook. The primary pocketbook and at least one removably attached secondary carrier(s) each having an entrance-way for opening them and at least one of the primary pocketbook and the removably attached secondary carrier(s) have a device(s) for closing the entrance-way, which device(s) for closing comprises at least one of the following Velcro®, snaps, magnets, one or more loops or rings, an interlocking ring or rings, zippers, buttons, carabiner(s), hook(s), buckles, a circular ring and/or non-circular shaped loop made of metal, plastic, and/or wood. There can be more than one removably attached secondary carrier(s) and each of the removably attached secondary carrier(s) are comprised of at least one of the following in any combination of a tote, pouch, purse, wallet, handbag, pocketbook, cellphone case, eyewear case, or clutch. The device for removably attaching can be located on the inside or outside or both the inside and outside of the primary pocketbook for attaching the primary pocketbook and removably attached secondary carrier(s) together. The device for removably attaching can be comprised of at least one of the following Velcro®, snaps, magnets, one or more loops or rings, an interlocking ring or rings, zippers, buttons, carabiner(s), hook(s), buckles, a circular ring and/or non-circular shaped loop made of metal, plastic, and/or wood. At least one of the primary pocketbook, and/or removably attached secondary carrier(s) can have a removable flexible strap(s) removably attached to it by at least one device for removably attaching, so that the primary pocketbook and/or removably attached secondary carrier(s) can be carried on the shoulder(s), or by hand(s). In this pocketbook system the same removable flexible strap(s) can be removably detached from the primary pocketbook or any of the removably attached secondary carrier(s) and attached to any of the primary pocketbook or any other removably attached secondary carrier(s) in the pocketbook system, so that the primary pocketbook and/or any of the removably attached secondary carrier(s) can be carried on the shoulder(s) or by hand(s). The primary pocketbook and the secondary removable carrier(s) both can have an opening in it or a loop attached to it for receiving such device for removably attaching the secondary carrier(s) to the inside or outside of the primary pocketbook or for attaching the primary pocketbook and removably attached secondary carrier(s) together. The strap(s) can also have an opening or a loop attached to it for receiving such device for removably attaching. This pocketbook system can have at least two removable carrier(s) can be removably attached at one or more points of attachment using a device for removably attaching In this pocketbook system the primary pocketbook and secondary removable carrier(s) can be removably attached at one or more points of attachment using a device for removably attaching the carriers, such device comprising any of Velcro®, snaps, magnets, one or more loops or rings, an interlocking ring or rings, zippers, buttons, carabiner(s), hook(s), buckles, a circular ring and/or non-circular shaped loop made of metal, plastic, and/or wood. A device for removably attaching, such device can be a circular ring that has a hinge in the circle so that part of the ring can be pushed inwardly to open. The primary pocketbook and secondary removable carrier(s) can be removably attached at one or more points of attachment using a device for removably attaching, such device comprising a circular ring that has a hinge in the circle so that part of the ring can be pushed inwardly to open and the ring has angled ends at either end of the opening which dovetail together when the opening is closed in a complete circle. In this pocketbook system any of the openings for receiving a device(s) for removably attaching can have grommets to reinforce the opening(s). Any of the attaching rings or loops can also be used to attach one or more straps to either or both the primary pocketbook and the removably attached secondary carrier(s). Also any of at least one of the primary pocketbook and/or a removably attaching secondary carrier(s) can have two straps connected together to form one long strap. Any of at least one of the primary pocketbook and/or a removably attaching secondary carrier(s) can have two straps attached to it and the two straps can be connected together at one end by at least one device(s) for removably attaching to form one long strap. At least one device(s) for removably attaching the secondary carrier(s) to the inside or outside of the primary pocketbook or for attaching the primary pocketbook and removably attached secondary carrier(s) together and the at least one device(s) for removably attaching the removable flexible strap(s) to at least one of the primary pocketbook or the removably attached secondary carrier(s) can be the same one device. Additionally the pocketbook system can also comprise of a primary pocketbook for carrying certain contents; one or more removably attached secondary carrier(s) for carrying certain contents removably attached to the inside of the primary pocketbook; one or more removably attached secondary carrier(s) for carrying certain contents removably attached to the outside of the primary pocketbook; at least one device(s) for removably attaching at least one secondary carrier(s) to the inside of the primary pocketbook; at least one device(s) for removably attaching at least one secondary carrier(s) to the outside of the primary pocketbook or for attaching the primary pocketbook and removably attached secondary carrier(s) together; at least one removable flexible strap(s); at least one device(s) for removably attaching the removable flexible strap(s) to at least one of the primary pocketbook or the removably attached secondary carrier(s); and/or at least one of the primary pocketbook, removably attached secondary carrier(s), and/or removable flexible strap(s) having an opening in or a loop attached to it for receiving a device for removably attaching. At least both the primary pocketbook and at least one removably attached secondary carrier(s) can both have at least one device(s) for removably attaching. At least one of the device(s) for removably attaching the primary pocketbook and at least one removably attached secondary carrier(s), can both have at least one of the device(s) for removably attaching be a magnet(s), in male or female form which can be completely covered with fabric material to conceal and cover-up the devices. At least one device(s) for removably attaching the secondary carrier(s) to the inside or outside of the primary pocketbook and the at least one device(s) for removably attaching the removable flexible strap(s) to at least one of the primary pocketbook or the removably attached secondary carrier(s) can be the same one device.

What is claimed is:

1. A pocketbook system comprising:

a primary pocketbook for carrying certain contents, said primary pocketbook having an inside and an outside;

a first one or more secondary carrier for carrying certain contents, said first one or more secondary carrier being removably attached to the inside of the primary pocketbook;

a second one or more secondary carrier for carrying certain contents, said second one or more secondary carrier being removably attached to the outside of the primary pocketbook;

a first at least one device for removably attaching the first one or more secondary carrier to the inside of the primary pocketbook;

a second at least one device for removably attaching the second one or more secondary carrier to the outside of the primary pocketbook or for attaching the primary pocketbook and the second one or more secondary carrier together;

at least one removable flexible strap; and a third at least one device for removably attaching the at least one removable flexible strap to at least one of the primary pocketbook, the first one or more secondary carrier or the second one or more secondary carrier, wherein at least one of the primary pocketbook, the first one or more secondary carrier, the second one or more secondary carrier, or the at least one removable flexible strap includes an opening therein or a loop attached thereto for receiving the third at least one device for removably attaching the at least one removable flexible strap and wherein the primary pocketbook and one of the first one or more secondary carrier and the second one or more secondary carrier includes an opening therein or a loop attached thereto for receiving the first at least one device for removably attaching the first one or more secondary carrier to the inside of the primary pocketbook or for receiving the second at least one device for removably attaching the second one or more secondary carrier to the inside or outside of the primary pocketbook, and at least one additional loop being attached to the primary pocketbook, the first one or more secondary carrier, or the second one or more secondary carrier, the at least one additional loop being placed in a lower position than the loop, whereby the primary pocketbook and one of the first one or more secondary carrier or the second one or more secondary carrier can fold down over itself and have the at least one additional loop available for use.

2. The pocketbook system in claim 1 wherein the at least one removable flexible strap has an opening or a loop attached to the primary pocketbook for receiving the first at least one device for removably attaching the first one or more secondary carrier-to the inside of the primary pocketbook or the second at least one device for removably attaching the second one or more secondary carrier to the outside of the primary pocketbook.

3. The pocketbook system in claim 1 wherein the primary pocketbook and the first one or more secondary carrier or the second one or more secondary carrier can be removably attached at one or more points of attachment using a device for removably attaching the first one or more secondary carrier or the second one or more secondary carrier.

4. The pocketbook system in claim 1 wherein the primary pocketbook and the first one or more secondary carrier or the second one or more secondary carrier can be removably attached at one or more points of attachment using a device for removably attaching, such device comprising at least one of Velcro®, snap, magnet, loop, ring, interlocking ring, zipper, button, carabiner, hook, buckle, and circular ring and non-circular shaped loop.

5. The pocketbook system in claim 1 wherein the first one or more secondary carrier and the second one or more secondary carrier are removably attached at one or more points of attachment using a device for attaching, detaching, and re-attaching the carriers, such device comprising at least one of Velcro®, snap, magnet, loop, ring, interlocking ring, zipper, button, carabiner, hook, buckle, and circular ring and non-circular shaped loop.

6. The pocketbook system in claim 1 wherein the primary pocketbook, the first one or more secondary carrier and the second one or more secondary carrier are removably attached at one or more points of attachment using a device for attaching, detaching, and re-attaching removably attaching the bags, such device comprising a circular ring that has a hinge in the circle so that part of the ring can be pushed inwardly to open.

7. The pocketbook system in claim 1 wherein the primary pocketbook, the first one or more secondary carrier and the second one or more secondary carrier are removably attached at one or more points of attachment using a device for attaching, detaching, and re-attaching, such device comprising a circular ring that has a hinge in the circle so that part of the ring can be pushed inwardly to open and the ring has angled ends at either end of the opening whereby the angled ends dovetail together to form a complete ring when closed.

8. The pocketbook system in claim 1 wherein the openings for receiving a device for removably attaching have grommets to reinforce the openings.

9. The pocketbook system in claim 1 wherein the first at least one device, the second at least one device and the third at least one device are the same device.

10. The pocketbook system in claim 1 wherein the primary pocketbook is comprised of at least one of a tote, pouch, purse, handbag, pocketbook, or clutch.

11. The pocketbook system in claim 1 wherein the first one or more secondary carrier is comprised of at least one of a tote, pouch, purse, handbag, pocketbook, clutch, wallet, cellphone case, organizer, make-up case, or eyewear case.

12. The pocketbook system in claim 1 wherein the second one or more secondary carrier is comprised of at least one of a tote, pouch, purse, handbag, pocketbook, clutch, wallet, cellphone case, organizer, make-up case, or eyewear case.

13. The pocketbook system in claim 1 wherein the first one or more secondary carrier is used for carrying certain of the contents of the pocketbook system in or on the first one or more secondary carrier alone.

14. The pocketbook system in claim 1 wherein the second one or more secondary carrier is used for carrying certain of the contents of the pocketbook system in or on the second one or more secondary carrier alone.

15. The pocketbook system in claim 1 wherein the first one or more secondary carrier or the second one or more secondary carrier is a secondary pocketbook, which is different from the primary pocketbook, having one or more openings, slits or pockets, for carrying certain of the contents of the pocketbook system.

16. The pocketbook system in claim 1 wherein the first one or more secondary carrier or the second one or more secondary carrier includes any combination of large and small openings for holding or fastening any type of accessory or contents that could be carried in a pocketbook.

17. The pocketbook system in claim 1 wherein the primary pocketbook and at least one of the first one or more secondary carrier and the second one or more secondary carrier each has an entrance-way and at least one of the primary pocketbook, the first one or more secondary carrier, and the second one or more secondary carrier includes at least one device for closing the entrance-way, said at least one device for closing comprising at least one of Velcro®, snap, magnet, loop, ring, interlocking ring, zipper, button, carabiner, hook, buckle, and circular ring and non-circular shaped loop.

18. The pocketbook system in claim 1 wherein the first at least one device for removably attaching, the second at least one device for removably attaching, or the third at least one device for removably attaching.

19. The pocketbook system in claim 1 wherein the at least one removable flexible strap is comprised of two straps connected together to form a single long strap.

20. The pocketbook system in claim 1 wherein at least one of the primary pocketbook, the first one or more secondary carrier, and the second one or more secondary carrier has two straps attached thereto, wherein the two straps are connected together at one end to form a single long strap.

* * * * *